US007678752B2

(12) United States Patent
Panandiker et al.

(10) Patent No.: US 7,678,752 B2
(45) Date of Patent: Mar. 16, 2010

(54) FABRIC CARE COMPOSITION COMPRISING ORGANOSILICONE MICROEMULSION AND ANIONIC/NITROGEN-CONTAINING SURFACTANT SYSTEM

(75) Inventors: Rajan Keshav Panandiker, West Chester, OH (US); Kerry Andrew Vetter, Cincinnati, OH (US); Mary Jane Combs, Covington, KY (US); David Gladney, Jr., Cincinnati, OH (US); Connie Lynn Sheets, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 222 days.

(21) Appl. No.: 11/725,741

(22) Filed: Mar. 20, 2007

(65) Prior Publication Data

US 2007/0225198 A1 Sep. 27, 2007

Related U.S. Application Data

(63) Continuation-in-part of application No. 11/584,972, filed on Oct. 23, 2006, now Pat. No. 7,608,575.

(60) Provisional application No. 60/729,622, filed on Oct. 24, 2005.

(51) Int. Cl.
*C11D 9/36* (2006.01)
*C11D 1/86* (2006.01)
*C11D 3/386* (2006.01)

(52) U.S. Cl. ..... 510/347; 510/276; 510/290; 510/300; 510/320; 510/332; 510/333; 510/340; 510/341; 510/343; 510/350; 510/351; 510/356; 510/357; 510/392; 510/422; 510/423; 510/426; 510/427; 510/433; 510/466; 510/490; 510/501

(58) Field of Classification Search ..... 510/276, 510/290, 320, 332, 333, 340, 341, 343, 350, 510/351, 356, 357, 392, 422, 423, 426, 427, 510/433, 466, 490, 501
See application file for complete search history.

(56) References Cited

U.S. PATENT DOCUMENTS 4,483,779 A 11/1984 Llenado et al.
4,483,780 A 11/1984 Llenado
4,565,647 A 1/1986 Llenado
5,173,201 A 12/1992 Coffindaffer et al.
5,188,769 A 2/1993 Connor et al.
5,332,528 A 7/1994 Pan et al.
5,445,747 A 8/1995 Kvietok et al.
5,458,809 A 10/1995 Fredj et al.
5,500,138 A 3/1996 Bacon et al.
5,531,910 A 7/1996 Severns et al.
5,532,023 A 7/1996 Vogel et al.
5,549,840 A 8/1996 Mondin et al.
5,576,282 A 11/1996 Miracle et al.
5,585,343 A * 12/1996 McGee et al. ..... 512/1
5,597,936 A 1/1997 Perkins et al.
5,620,952 A 4/1997 Fu et al.
5,646,101 A 7/1997 MacBeath
5,661,215 A * 8/1997 Gee et al. ..... 524/837
5,686,014 A 11/1997 Baillely et al.
5,695,679 A 12/1997 Christie et al.
5,698,504 A 12/1997 Christie et al.
5,705,464 A 1/1998 Scheper et al.
5,710,115 A 1/1998 Patel et al.
5,712,343 A 1/1998 Geck et al.
5,741,760 A * 4/1998 Mondin et al. ..... 510/365
5,759,208 A 6/1998 Zhen et al.
5,759,983 A * 6/1998 Mondin et al. ..... 510/365
5,817,614 A 10/1998 Miracle et al.
5,997,886 A * 12/1999 Peffly et al. ..... 424/401
6,008,181 A 12/1999 Cripe et al.
6,020,303 A 2/2000 Cripe et al.
6,060,443 A 5/2000 Cripe et al.
6,071,867 A * 6/2000 Purcell et al. ..... 510/174
6,080,708 A 6/2000 Glenn, Jr. et al.
6,093,410 A * 7/2000 Peffly et al. ..... 424/401
6,093,856 A 7/2000 Cripe et al.
6,111,056 A 8/2000 Hildebrandt et al.
6,149,898 A * 11/2000 Peffly et al. ..... 424/70.12
6,150,322 A 11/2000 Singleton et al.
6,153,569 A * 11/2000 Halloran ..... 510/119
6,153,577 A 11/2000 Cripe et al.
6,191,090 B1 2/2001 Mondin et al.
6,225,464 B1 5/2001 Hiler, II et al.
6,251,246 B1 6/2001 Chan
6,274,540 B1 8/2001 Scheibel et al.
6,306,812 B1 10/2001 Perkins et al.
6,306,817 B1 10/2001 Kott et al.
6,326,348 B1 12/2001 Vinson et al.
6,369,024 B1 4/2002 Panandiker et al.
6,410,493 B1 * 6/2002 Garnier ..... 510/119
6,482,787 B1 11/2002 Panandiker et al.
6,482,994 B2 11/2002 Scheper et al.
6,491,840 B1 12/2002 Frankenbach et al.

(Continued)

FOREIGN PATENT DOCUMENTS

WO WO 92/06154 A1 4/1992

(Continued)

OTHER PUBLICATIONS

U.S. Appl. No. 12/560,639, filed Sep. 16, 2009, Panandiker, et al.

(Continued)

*Primary Examiner*—Charles I Boyer
(74) *Attorney, Agent, or Firm*—Nicole M. Tepe; Julie McConihay; Kim William Zerby

(57) ABSTRACT

Systems, compositions and methods for fabric laundering comprising selected organosilicones which are formulated into microemulsions for improved deposition onto fabrics to provide fabric care benefits.

19 Claims, No Drawings

U.S. PATENT DOCUMENTS

| | | | | |
|---|---|---|---|---|
| 6,514,926 | B1 | 2/2003 | Kott et al. | |
| 6,525,233 | B1 | 2/2003 | Connor et al. | |
| 6,566,319 | B1 | 5/2003 | Scheibel et al. | |
| 6,583,096 | B1 | 6/2003 | Kott et al. | |
| 6,593,285 | B1 | 7/2003 | Scheibel et al. | |
| 6,602,840 | B1 | 8/2003 | Scheibel et al. | |
| 6,733,538 | B1 | 5/2004 | Panandiker et al. | |
| 6,823,828 | B2 | 11/2004 | Nishi et al. | |
| 6,844,309 | B1 | 1/2005 | Sivik et al. | |
| 6,903,061 | B2 | 6/2005 | Masschelein et al. | |
| 6,908,962 | B1 * | 6/2005 | Frankenbach et al. | 524/588 |
| 7,306,369 | B2 | 12/2007 | Curry et al. | |
| 7,319,120 | B2 | 1/2008 | Herzig et al. | |
| 7,608,575 | B2 | 10/2009 | Panandiker et al. | |
| 2002/0173439 | A1 | 11/2002 | Murphy | |
| 2004/0157754 | A1 * | 8/2004 | Geary et al. | 510/119 |
| 2004/0220072 | A1 * | 11/2004 | Trinh et al. | 510/475 |
| 2005/0060811 | A1 * | 3/2005 | Smith et al. | 8/115.51 |
| 2005/0089536 | A1 * | 4/2005 | Loffler et al. | 424/401 |
| 2005/0098759 | A1 * | 5/2005 | Frankenbach et al. | 252/8.91 |
| 2005/0129643 | A1 | 6/2005 | Lepilleur et al. | |
| 2005/0164896 | A1 | 7/2005 | Dabkowski et al. | |
| 2006/0292100 | A1 * | 12/2006 | Nguyen et al. | 424/70.12 |
| 2007/0093409 | A1 | 4/2007 | Panandiker et al. | |
| 2007/0241306 | A1 * | 10/2007 | Wehner et al. | 252/67 |
| 2008/0207773 | A1 * | 8/2008 | Loffler et al. | 514/772.3 |

FOREIGN PATENT DOCUMENTS

| | | | |
|---|---|---|---|
| WO | WO 92/06162 | A1 | 4/1992 |
| WO | WO 99/05084 | A1 | 2/1999 |
| WO | WO 03/000207 | A2 | 1/2003 |

OTHER PUBLICATIONS

International Search Report, International Application No. PCT/IB2006/053821, date of mailing Mar. 8, 2007, 4 pages.

* cited by examiner

FABRIC CARE COMPOSITION COMPRISING ORGANOSILICONE MICROEMULSION AND ANIONIC/NITROGEN-CONTAINING SURFACTANT SYSTEM

CROSS-REFERENCE TO RELATED APPLICATIONS

This application is a continuation-in-part of U.S. patent application Ser. No. 11/584,972, filed Oct. 23, 2006, now U.S. Pat. No. 7,608,575 which in turn claims priority to U.S. Provisional Patent Application No. 60/729,622, filed Oct. 24, 2005.

FIELD OF THE INVENTION

The present disclosure relates to fabric care compositions and systems comprising selected organosilicones and methods of making and employing the same.

BACKGROUND OF THE INVENTION

With the increased hustle and bustle in the modern world, there is a demand for reducing the labor involved in home laundering, as well as the cost and time involved in dry cleaning, commercial laundering and the like. This demand has placed pressure upon textile technologists to produce a product that will sufficiently reduce wrinkles in fabrics, especially clothing, and to produce a good appearance through simple, convenient use of the product.

Organosilicones have been used as one means of reducing wrinkles, softening fabrics and the like. Organosilicones have typically been employed in laundry and/or fabric care compositions in the form of aqueous macroemulsions. Recently, organosilicone microemulsions having average particles sizes in the range of about 0.1 microns or less have been disclosed. Without wishing to be bound by theory, it is believed that the use of such microemulsions may be advantageous over the use of conventional macroemulsions in at least one or more of the following non-limiting aspects: (1) microemulsions may have a higher phase stability in liquid fabric care compositions, particularly those with low viscosities, such that they will not migrate to the top of the compositions during storage; (2) microemulsions may require less energy to manufacture; (3) microemulsions may be translucent and/or transparent, such that when incorporated into a liquid formulation, the resulting product may have a clearer, more pleasing appearance; and (4) microemulsions may have little or no effect on the sudsing of detergents in the wash liquor.

Silicone emulsions are typically produced by the conventional process of emulsifying an organosilicone in water with emulsifiers. A typical silicone macroemulsion may be made from compositions comprising from about 30% to about 80% silicone, from about 5% to about 20% emulsifier, and the remainder being water. In comparison, a typical silicone microemulsion may be made from a composition comprising relatively less silicone, but relatively more emulsifier; silicone microemulsions are typically made from compositions comprising from about 10% to about 30% silicone, from about 10% to about 40% emulsifier, and the remainder being water. The use of a relatively high level of emulsifier in a microemulsion may increase the cost of the microemulsion. Moreover, the relatively low concentration of silicone in the microemulsion may require the use of a greater volume of microemulsion, which in turn may add to the associated costs of its transportation, storage and the like.

Thus in spite of the advances in the art, there remains a need for improved fabric care compositions comprising organosilicone microemulsions. In some instances, it may be desirable to provide a process wherein silicone fluids are incorporated directly into liquid laundry compositions such that microemulsions are formed in situ in the liquid laundry composition. Such an improved process could circumvent the use of unnecessarily large amounts of surfactant in the production of microemulsions, as well as the associated costs of transportation, storage and the like.

In some instances, it may be desirable to improve the deposition of organosilicones onto fabrics during the aqueous laundering/cleaning process, for example by overcoming the conflict between the cleaning operation, which removes substances from fabric, and the fabric care operation, which may require deposition of care actives (such as organosilicones) onto the fabric.

In some instances, it may be desirable to provide a laundry detergent composition which combines laundry adjuncts and selected organosilicones in such a way as to simultaneously achieve superior fabric cleaning and fabric care. It may be desirable that such laundry detergents exhibit formulation stability and/or a clear or translucent appearance, all of which may contribute to an aesthetically pleasing product.

SUMMARY OF THE INVENTION

The present invention addresses the above-identified technical problems via the selection of specific organosilicones, identified in detail hereinafter. The selected organosilicones are suitable for preparing microemulsions which may deliver superior fabric care in fabric laundering. Moreover, given proper attention both to the selection of the organosilicones and to the formulation adjuncts, unexpectedly good fabric care and/or consumer acceptance of the home laundry product can be obtained.

In one aspect, the present invention provides: A liquid detergent composition for fabric cleaning and fabric care comprising:

(a) an organosilicone;

(b) an emulsifier comprising anionic surfactant;

(c) other laundry adjunct materials; and (d) a carrier comprising water;

wherein the organosilicone is in the form of aqueous microemulsion having an average particle size less than about 100 nm.

Organosilicones of use in the present liquid detergent compositions may be selected from the following general formula (I):

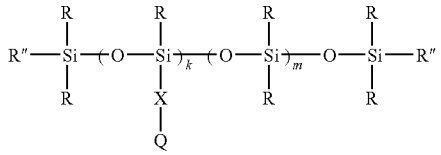

(I)

wherein:

(a) each R" is independently selected from R and —X-Q; wherein:

(i) R is a group selected from: a $C_1$-$C_8$ alkyl or aryl; hydrogen; a $C_1$-$C_3$ alkoxy; and combinations thereof;

(b) X is a linking group selected from: an alkylene; $—(CH_2)_p—$; or $—CH_2—CH(OH)—CH_2—$; wherein:

(i) p is on average from about 2 to about 6, (c) Q is $—(O—CHR_2—CH_2)_q—Z$; wherein q is on average from about 0 to about 20; and further wherein:

(i) $R_2$ is a group selected from: H; or a $C_1$-$C_3$ alkyl; and (ii) Z is a group selected from: $—OR_3$; $—OC(O)R_3$; $—CO—R_4—COOH$; $—SO_3$; $—PO(OH)_2$; and:

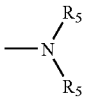

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;
2. $R_4$ is a group selected from: $—CH_2—$; or $—CH_2CH_2—$;
3. $R_5$ is a group independently selected from: H; $C_1$-$C_3$ alkyl; $—CH_2)_p—NH_2$; and $—X(—O—CHR_2—CH_2)_s—Z$; wherein:
   a. p is on average from about 2 to about 6; and
   b. s is on average from about 1 to about 10;

(d) k is on average from about 1 to about 25,000, or from about 3 to about 12,000; and (e) m is on average from about 4 to about 50,000, or from about 10 to about 20,000.

The present invention has numerous advantages, including, but not limited to, one or more aspects of superior fabric care or garment care as exemplified by one or more of: superior garment appearance; excellent tactile characteristics, superior fabric feel; fabric softness; reduction, removal and/or prevention of creases or wrinkles in garments; superior ease of ironing; garment shape retention and/or shape recovery; and fabric elasticity. The invention has further advantages, depending on the precise embodiment, which include superior formulation flexibility and/or formulation stability of the laundry compositions provided.

The present invention delivers unexpectedly enhanced deposition of organosilicones which previously were lost in the wash liquor. Moreover, superior fabric care or garment benefits may be secured when the products herein are used in steps of the fabric laundering process, such as pre-treatment before washing in an automatic washing machine (pretreatment benefits), through-the wash benefits, through the rinse benefits and post-treatment benefits.

The silicone emulsions of use in the present invention also provide the advantage of being emulsified: prior to addition into liquid detergent compositions; after addition into liquid detergent compositions, i.e., in situ emulsion formation; and combinations thereof.

These and other embodiments, aspects, and advantages are encompassed within the present invention, and will become better understood with regard to the following description and appended claims.

DETAILED DESCRIPTION OF THE INVENTION

Definitions

The terms "adjunct" and "laundry adjunct", as interchangeably used herein, refer to any liquid, solid or gaseous material selected for use with the alkoxylated organosilicone polymers in the present compositions. Adjuncts may be inherently compatible with the alkoxylated organosilicone polymer(s) and with other ingredients present in compositions of the present invention. When adjuncts are not inherently compatible, they may be included through any suitable technique. Non-limiting examples of such techniques include changing the order of addition in manufacturing processes via encapsulation, using multi-part compositions to be mixed at the point of use, and the like.

The term "treated substrate," as used herein means a substrate, including, but not limited to a fabric or garment, having one or more of the fabric care benefits described herein as imparted thereto by a composition comprising the selected organosilicones of the invention. The terms "substrate", "fabric" and "garment" are used interchangeably herein.

The term "fabric care composition" as used herein, refers to compositions that provide cleaning and/or fabric care benefits. "Fabric care compositions" may include, but are not limited to, "detergent compositions".

"Liquid detergent composition" as used herein, refers to compositions that are in a form selected from the group of: "pourable liquid"; "gel"; "cream"; and combinations thereof.

"Pourable liquid" as defined herein refers to a liquid having a viscosity of less than about 2000 mPa*s at 25° C. and a shear rate of 20 $sec^{-1}$. In some embodiments, the viscosity of the pourable liquid may be in the range of from about 200 to about 1000 mPa*s at 25° C. at a shear rate of 20 $sec^{-1}$. In some embodiments, the viscosity of the pourable liquid may be in the range of from about 200 to about 500 mPa*s at 25° C. at a shear rate of 20 $sec^{1}$.

"Gel" as defined herein refers to a transparent or translucent liquid having a viscosity of greater than about 2000 mPa*s at 25° C. and at a shear rate of 20 $sec^{-1}$. In some embodiments, the viscosity of the gel may be in the range of from about 3000 to about 10,000 mPa*s at 25° C. at a shear rate of 20 $sec^{-1}$ and greater than about 5000 mPa*s at 25° C at a shear rate of 0.1 $sec^{-1}$.

"Cream" and "paste" are used interchangeably and as defined herein refer to opaque liquid compositions having a viscosity of greater than about 2000 mPa*s at 25° C. and a shear rate of 20 $sec^{1}$. In some embodiments, the viscosity of the cream may be in the range of from about 3000 to about 10,000 mPa*s at 25° C. at a shear rate of 20 $sec^{-1}$, or greater than about 5000 mPa*s at 25° C. at a shear rate of0.1 $sec^{1}$.

As used herein, an "effective amount" of a material or composition is the amount needed to accomplish an intended purpose, for example, to impart a desired level of fabric care benefit to a substrate.

Markush language as used herein encompasses combinations of the individual Markush group members, unless otherwise indicated.

All percentages, ratios and proportions used herein are by weight percent of the undiluted liquid detergent composition, unless otherwise specified. All average values are calculated "by weight" of the liquid detergent composition or components thereof, unless otherwise expressly indicated.

"Comprising" as used herein means that various components, ingredients or steps can be conjointly employed in practicing the present invention. Accordingly, the term "comprising" encompasses the more restrictive terms "consisting essentially of" and "consisting of". The present compositions can comprise, consist essentially of or consist of any of the required and optional elements disclosed herein.

All numerical ranges disclosed herein, are meant to encompass each individual number within the range and to encompass any combination of the disclosed upper and lower limits of the ranges.

Fabric Care Compositions

Fabric care compositions of the present invention may be utilized for any suitable purpose or combination thereof. Suitable purposes include, but are not limited to, handwashing, machine washing, soaking and/or pretreatment (particularly of stained fabrics), use as a fabric care additive and the like. The present fabric care compositions are typically in a liquid form and may comprise carrier, which in turn comprises water. Encapsulated and/or unitized dose compositions are also encompassed within the present invention, as are compositions which form two or more separate, but combinedly dispensable, portions.

In some embodiments, fabric care compositions of the present invention comprise organosilicone microemulsions and other laundry adjuncts in a suitable carrier comprising water. These fabric care compositions may have a viscosity from about 1 to about 2000 mPa*s at 25° C. and a shear rate of 20 $sec^{-1}$, or from about 200 to about 800 mPa*s at 25° C. and a shear rate of 20 $sec^{-1}$. The viscosity may be measured using conventional methods. For example, viscosity may be measured using a TA Instruments AR1000 cone and plate viscometer, manufactured by TA Instruments (New Castle, Del.), using manufacturer-suggested operating conditions at about 25° C.

The fabric care compositions of the present invention comprise selected organosilicone polymers in the form of microemulsions. One or more of the following properties of the selected organosilicones may be conducive to formation of microemulsions in an aqueous laundry product: chemical structure, hydrophilic-lipophilic balance (i.e., "HLB value"), viscosity, molecular weight and the like. The selected organosilicones may be water insoluble or have limited water solubility. Suitable organosilicones are described in detail infra.

The fabric care compositions of the present invention typically comprise organosilicones from about 0.01 to about 10%, from about 0.5 to about 5% or from about 1 to about 3% by weight of the composition.

The fabric care compositions of the present invention may further comprise emulsifiers to assist and/or stabilize the microemulsification of the selected organosilicones in the selected carrier. Non-limiting examples of suitable carriers include those comprising water and optionally organic solvents. Non-limiting examples of suitable organic solvents include alcohols. In some embodiments, useful alcohols may be selected from propane diol, diethyleneglycol, hexyleneglycol, ethanol and combinations thereof.

Microemulsions are typically more stable than conventional macroemulsions and when incorporated into a liquid detergent composition, the resulting composition may have a clear appearance. Without wishing to be bound by theory, it is believed that when the liquid detergent composition is diluted, such as in a typical aqueous wash environment, the emulsifiers in the composition become diluted such that the organosilicones of the present invention coalesce to form significantly larger droplets; such droplets may have an average particle size of from about 0.005 microns (μm) to about 50 μm or from about 0.01 μm to about 10 μm. Since the selected organosilicones are water insoluble or have limited solubility in water, they may consequently phase-separate out of the wash liquor; this phase separation may result in more efficient deposition of the oraganosilicones onto the fabrics and consequently enhanced fabric care benefits. In a typical immersive wash environment, the liquid detergent composition is mixed with an excess of water to form a wash liquor, which typically has a weight ratio of water:liquid detergent composition of from about 10:1 to about 400:1, from about 10:1 to about 1,000:1 or from about 10:1 to about 1,500:1 .

In some embodiments of the invention, the liquid detergent compositions may comprise the selected organosilicones in amounts: from about 0.01% to about 10%, from about 0.1% to about 8%, from about 2% to about 6% or from about 3% to about 5%, by weight of the compositions; an "effective amount" of an emulsifier in a carrier comprising water; and optionally one or more organic solvents. The "effective amount" of an emulsifier is the amount sufficient to produce an organosilicone microemulsion in a carrier such as water. In some embodiments, the amount of emulsifiers ranges from about 1 to about 75 parts, or from about 25 to about 60 parts, per 100 weight parts of organosilicone.

In some embodiments of the invention, the liquid detergent compositions comprise at least about 0.01% by weight of the selected organosilicones. In some embodiments, the liquid detergent composition comprises from about 0.01% to about 10% by weight of the selected organosilicones.

Some embodiments of the present invention may further comprise an "effective amount" of an emulsifier and in addition each of: a crystalline, hydroxyl-containing stabilizing agent; a nitrogen-free nonionic detersive surfactant; a fixing agent for anionic dyes; and a carrier comprising water and an organic solvent. These liquid detergent compositions may further comprise anionic surfactants and/or other laundry adjuncts.

In some embodiments of the invention, the liquid detergent composition may comprise one or more laundry adjuncts. Non-limiting examples of laundry adjunct materials include perfume, fabric softener, enzyme, bleach, bleach activator, coupling agent, and combinations thereof. Unless specified herein below, the laundry adjuncts may be present in the liquid detergent composition in an "effective amount." An effective amount of a laundry adjunct may be from about 0.01%, from about 0.1%, or from about 1%, to about 20%, to about 15%, to about 10%, to about 7%, or to about 5% by weight of the fabric care compositions.

The balance of the fabric care compositions of the present invention may comprise a carrier comprising water. In some embodiments, the carrier comprises water which is present from about 50% to about 100% by weight, or from about 60% to about 90% by weight, of the carrier.

Organosilicone Microemulsions

Without wishing to be bound by theory, it is believed that organosilicone compounds and/or emulsions of organosilicone compounds may impart lubricity and smoothness to the fibers of a fabric, thereby allowing them to slip or glide easily past one another. It is further believed that the fiber slippage or gliding enhances the process of wrinkle release and/or wrinkle control in the fabric. Organosilicones may also provide a multitude of other fabric care benefits, including, but not limited to: fabric wear reduction; fabric pill prevention and/or reduction; fabric color maintenance and/or fading reduction; and combinations thereof. Organosilicones may also provide a variety of liquid detergent formulation benefits including, but not limited to: surface tension control; sudsing control; and combinations thereof.

The liquid detergent compositions of the present invention may contain an organosilicone microemulsion comprising organosilicone particles dispersed in a suitable carrier in the presence of an emulsifier. In some embodiments, the carrier comprises water and the emulsifier comprises anionic surfactant. The organosilicone microemulsions may have an average particle size less than about 0.1 μm, or less than about 0.08 μm. Microemulsions having particle sizes in this range typically provide a clear or transparent appearance in the resulting liquid detergent compositions. In some embodiments, the organosilicone microemulsions have average particle sizes ranging from about 0.005 μm to about 0.1 μm, from about 0.01 μm to about 0.08 μm, or from about 0.02 μm to about 0.05 μm. The average particle size of a microemulsion may be determined by conventional methods, such as using a Malvern ZetaNano ZS particle sizer, manufactured by Malvern Instruments, Inc. (Southborough, Mass.). The methods for particle size measurements are described in *Dynamic Light Scattering Applications of Photon Correlation Spectroscopy*, by. R. Pecora (Plenum Press, NY 1985).

The present microemulsions typically comprise from about 10% to about 70%, or from about 25% to about 60%, by weight of the microemulsion of the dispersed organosilicones; from about 0.1% to about 30%, or from about 1% to about 20%, by weight of the microemulsion of anionic surfactant; optionally, from about 0% to about 30%, or from about 0.1% to about 20%, by weight of the microemulsion of nonionic surfactant; and the balance of the microemulsion comprises water, and optionally other carriers.

The present organosilicone microemulsions may be produced in situ in a liquid detergent composition using any suitable means. For example, a neat organosilicone fluid according to the present invention may be slowly added directly into a liquid detergent while mixing vigorously. In addition, or in the alternative, the present organosilicone microemulsions may be produced using any suitable means and then added to the liquid detergent. In any case, selected organosilicones may be present in the liquid detergent compositions of the present invention from about 0.1% to about 20%, from about 0.5% to about 10%, or from about 1% to about 5%, by weight of the liquid detergent composition.

(a) Organosilicones

Organosilicones suitable for use in the present invention have the general formula (I):

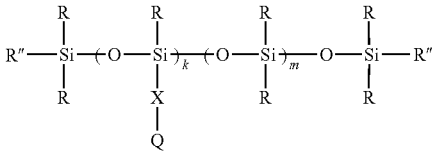

(I)

wherein:

(a) each R" is independently selected from R and —X-Q; wherein:

(i) R is a group selected from: a $C_1$-$C_8$ alkyl or aryl; hydrogen; a $C_1$-$C_3$ alkoxy; and combinations thereof;

(b) X is a linking group selected from: an alkylene; $—(CH_2)_p—$; or $—CH_2—CH(OH)—CH_2—$; wherein:

(i) p is on average from about 2 to about 6, (c) Q is $—(O—CHR_2—CH_2)_q—Z$; wherein q is on average from about 0 to about 20; and further wherein:

(i) $R_2$ is a group selected from: H; or a $C_1$-$C_3$ alkyl; and (ii) Z is a group selected from: $—OR_3$; $—OC(O)R_3$; $—CO—R_4—COOH$; $—SO_3$; $—PO(OH)_2$; and:

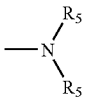

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;
2. $R_4$ is a group selected from: $—CH_2—$; or $—CH_2CH_2—$;
3. $R_5$ is a group independently selected from: H; $C_1$-$C_3$ alkyl; $—(CH_2)_p—NH_2$; and $—X(—O—CHR_2—CH_2)_s—Z$; wherein:
   a. p is on average from about 2 to about 6; and
   b. s is on average from about 1 to about 10;

(d) k is on average from about 1 to about 25,000, or from about 3 to about 12,000; and (e) m is on average from about 4 to about 50,000, or from about 10 to about 20,000.

In some embodiments, R is selected from $C_1$-$C_4$ alkyl. In some embodiments, p is on average from about 2 to about 3.

In typical embodiments, the selected organosilicones suitable for use herein have a viscosity ranging from about 10 to about 600,000 mPa*s at 25° C. and a shear rate of 20 $sec^{-1}$. In other embodiments, the selected organosilicones have a viscosity from about 10 to about 100,000 mPa*s at 25° C. and a shear rate of 20 $sec^{1}$. These selected organosilicones typically have the solubility in water of less than about 10 grams per liter (g/L), or less than about 1 g/L, at 25° C. Without wishing to be bound by theory, it is believed that if the solubility of an organosilicone is greater than about 10 g/L, it will remain soluble in the wash liquor and consequently will not deposit onto the fabrics.

One class of organosilicones suitable for use in the present invention are terminal organosilicones having the general formula (II):

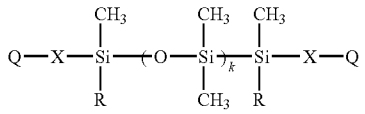

(II)

wherein:

(a) each R is a group independently selected from: a $C_1$-$C_8$ alkyl or aryl; hydrogen; a $C_1$-$C_3$ alkoxy; or combinations thereof;

(b) X is a linking group selected from an alkylene group; in some embodiments the alkylene group is selected from: $—(CH_2)_p—$; and $—CH_2—CH(OH)—CH_2—$; wherein:

(i) p is on average from about 2 to about 6;

(c) Q is $—(O—CHR_2—CH_2)_q-Z$; wherein q is on average from about 0 to about 20; and further wherein:

(i) $R_2$ is a group selected from: H; or a $C_1$-$C_3$ alkyl; and (ii) Z is a group selected from: $—OR_3$; $—OC(O)R_3$; $—CO—R_4—COOH$; $—SO_3$; $—PO(OH)_2$; and

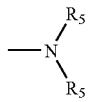

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;

2. $R_4$ is a group selected from: —$CH_2$—; and —$CH_2CH_2$—;
3. $R_5$ is a group independently selected from: H; $C_1$-$C_3$ alkyl; —$(CH_2)_p$—$NH_2$; and —X(—O—$CHR_2$—$CH_2)_s$—Z; wherein:
   a. p is on average from about 2 to about 6; and
   b. s is on average from about 1 to about 10; and (d) k is on average from about 1 to about 25,000, or from about 3 to about 12,000; and (e) m is on average from about 4 to about 50,000, or from about 10 to about 20,000.

In some embodiments, R is selected from $C_1$-$C_4$ alkyl. In some embodiments, p is on average from about 2 to about 3.

Non-limiting examples of this class of organosilicone polymers include: KF-888, KF-889, both of which are available from Shin Etsu Silicones (Akron, Ohio); and DC-5562, which is available from Dow Coming Corporation (Midland, Mich.).

Another class of organosilicones of use in the present invention includes the pendant-type polyalkylene oxide polysiloxanes. In some embodiments, the polyalkylene oxide polysiloxanes comprise a dimethyl polysiloxane hydrophobic moiety and one or more hydrophilic polyalkylene oxide chains. This class of organosilicones has the general formula (III):

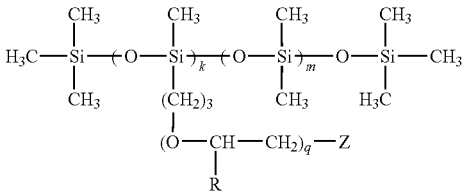

(III)

wherein:

(a) R is a group selected from: hydrogen or $C_1$-$C_3$ alkyl;

(b) Z is a group selected from: —$OR_3$; —OC(O)$R_3$; —CO—$R_4$—COOH; —$SO_3M$; —$PO(OH)_2$; and:

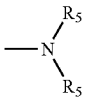

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;
2. $R_4$ is a group selected from: —$CH_2$—; and —$CH_2CH_2$—;
3. $R_5$ is a group independently selected from: H, $C_1$-$C_3$ alkyl; —$(CH_2)_p$—$NH_2$; and —X(—O—$CHR_2$—$CH_2)_s$—Z; ; wherein:
   a. p is on average from about 2 to about 6; and
   b. s is on average from about 1 to about 10; and (c) k is on average from about 1 to about 25,000, or from about 3 to about 12,000.

In some embodiments, R is selected from $C_1$-$C_4$ alkyl. In some embodiments, p is on average from about 2 to about 3. In some embodiments, $R_3$ is a group selected from: H; methyl; ethyl propyl; and benzyl groups.

The hydrophilic polyakylene oxide chains can be incorporated as side chains (pendant moieties) or as block copolymer moieties with the polysiloxane hydrophobic moiety.

Polyalkylene oxide polysiloxanes suitable for use in the present invention have a HLB value less than about 7, or from about 2 to about 7. It is recognized that the HLB of the polymer will increase with an increasing amount of polyethylene oxide group in the polymer. Thus, suitable polyalkylene oxide polysiloxanes may have polyalkylene oxide content less than about 50%, less than about 35% or less than about 30% by weight of the polymer.

Suitable polyalkylene oxide polysiloxanes may comprise more than one type of alkoxy group; the higher the polyalkylene oxide content in the polysiloxanes, the more likely they are to contain more than one type of alkoxy group.

Polyalkylene oxide polysiloxanes suitable for use in the present invention may have a viscosity of 10-100,000 mPa*s at 25° C. and a shear rate of 20 $sec^{-1}$.

Non-limiting examples of such polysiloxanes with polyalkylene oxide include: FF400, DC5495, FZ2139, FZ2130, all of which are available from Dow Coming, Midland Mich.; Magnasoft® TLC, available from GE Silicones (Wilton, Conn.); KF8015, KF8016, KF8017, all of which are available from Shin Etsu Silicones (Akron, Ohio); Ultrasil® SW-12 and Ultrasil® DW-18 silicones, available from Noveon Inc. (Cleveland Ohio); and additional examples of polysiloxanes with polyalkylene oxide are KF-352®, KF-6015®, and KF-945®, all available from Shin Etsu Silicones (Tokyo, Japan).

Another class of organosilicones of use in the present invention are hydrophilic siloxanes that may be produce by forming the following reaction mixture: (a) organopolysiloxane having any of structures I-III (as described above) and at least one silicone-bonded hydrogen atom per molecule; with (b) an organic compound or compounds having two or more isocyanate groups per molecule; with the proviso that the water content of the reactants is less than about 2000 ppm by weight of the reaction mixture. This class of organosilicones is described in further detail in U.S. patent application Ser. No. 10/539,331.

In one embodiment of the present invention, hydrophilic siloxane is prepared by reacting organopolysiloxane having structure (I) with a polyamine comprising two or more amine groups per molecule and a compound comprising two or more isocyante groups per molecule. An example of the resulting hydrophilic siloxane is SLM 21-200, which is available from Wacker Silicones (Adrian, Mich.).

In some embodiments of the liquid detergent compositions of the present invention, mixtures of two or more of the above classes of polyalkylene oxide polysiloxanes are of use.

(b) Emulsifiers

Emulsifiers useful in aiding the formation and/or stability of organosilicone microemulsions in the liquid detergent compositions of the present invention include, but are not limited to, anionic surfactants. In some embodiments, nonionic surfactants useful as laundry adjuncts to provide detersive benefits can also aid the formation and stability of the microemulsions. In a typical embodiment, the amount of emulsifier of use is from about 0.05% to about 15%, or from about 1% to about 10%, by weight of the liquid detergent composition.

Non-limiting examples of anionic surfactants of use in the present invention include: alkyl sulfonates, such as $C_{11}$-$C_{18}$ alkyl benzene sulfonates (LAS) or $C_{10}$-$C_{20}$ branched-chain and random alkyl sulfates (AS); $C_{10}$-$C_{18}$ alkyl ethoxy sulfates ($AE_xS$) wherein x is on average from about 1 to about 30; mid-chain branched alkyl sulfates including, but not limited to those described in U.S. Pat. Nos. 6,020,303 and 6,060,443; mid-chain branched alkyl alkoxy sulfates including, but not limited to those disclosed in U.S. Pat. No. 6,008,181 and U.S. Pat. No. 6,020,303; $C_{10}$-$C_{18}$ alkyl alkoxy carboxylates comprising 1-5 ethoxy units; modified alkylbenzene sulfonate (MLAS) as disclosed in WO 99/05243, WO 99/05242, WO 99/05244, WO 99/05082, WO 99/05084, WO 99/05241, WO 99/07656, WO 00/23549, and WO 00/23548; $C_{12}$-$C_{20}$ methyl ester sulfonate (MES); $C_{10}$-$C_{18}$ alpha-olefin sulfonate (AOS); and $C_6$-$C_{20}$ sulfosuccinates; and combinations thereof.

Laundry Adjuncts (a) Stabilizer

The liquid detergent compositions of the present invention may comprise stabilizer. Any suitable level of stabilizer is of use; exemplary levels include from about 0.01% to about 20%, from about 0.1% to about 10%, or from about 0.1% to about 3% by weight of the composition. Without wishing to be bound by theory, it is believed that the stabilizer serves to stabilize the organosilicone in the inventive compositions and to prevent it from coagulating and/or creaming. This can be important when the inventive compositions are in a fluid form, as in the case of liquid or gel-form laundry detergents for heavy-duty or fine fabric wash use, and liquid or gel-form fabric treatments for pre- or post washing uses.

Non-limiting examples of stabilizers suitable for use herein include: a crystalline, hydroxyl-containing stabilizing agent; a trihydroxystearin, hydrogenated oil or a variation thereof; and combinations thereof.

In some embodiments, the incorporation and activation of a crystalline, hydroxyl-containing stabilizing agent into the present liquid detergent compositions is such that a thread-like structure is prepared. Details around this process of making such thread-like structuring systems are disclosed in U.S. Pat. No. 6,080,708.

Crystalline, hydroxyl-containing stabilizing agents are typically present in the liquid compositions of the present invention at a level of from about 0.1% to about 10%, from about 0.1% to about 3%, or from about 0.3% to about 2%, by weight of the liquid detergent composition.

In some embodiments, crystalline, hydroxyl-containing stabilizing agents can be water-insoluble wax-like substances, including fatty acid, fatty ester or fatty soap. In other embodiments, the crystalline, hydroxyl-containing stabilizing agents can be derivatives of castor oil, such as hydrogenated castor oil derivatives, for example, castor wax. In still other embodiments, the crystalline, hydroxyl-containing agent typically is selected from a group of:

(a) $R^1OCH_2CH(OR^2)CH_2OR^3$, wherein $R^1$ is —C(O)$R^4$, $R^2$ is $R^1$ or H, $R^3$ is $R^1$ or H, and $R^4$ is independently selected from a $C_{10}$-$C_{22}$ alkyl or alkenyl comprising at least one hydroxyl group;

(b)

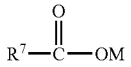

wherein:

$R^7$ is 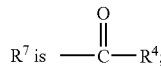 ;

$R^4$ is as defined above in (a); M is $Na^+$, $K^+$, $Mg^{++}$, $Al^{3+}$, or H; and (c) mixtures thereof Alternatively, the crystalline, hydroxyl-containing stabilizing agent may have the formula:

$$CH_3(CH_2)_aCHOH(CH_2)_xC(O)OCH_2CH(O(O)C(CH_2)_y,CHOH(CH_2)_bCH_3)—CH_2O(O)C(CH_2)_zCHOH(CH_2)_cCH_3$$

wherein:

(x+a) is from 11 to 17; (y+b) is from 11 to 17; and (z+c) is from 11 to 17; and in some embodiments wherein x=y=z=10 and/or wherein a=b=c=5.

Commercially available crystalline, hydroxyl-containing stabilizing agents include THIXCIN® from Rheox, Inc (Highstown, N.J.).

Stabilizers suitable of use in the liquid detergent compositions of the present invention may be selected from thickening stabilizers. These stabilizers may be present at levels of from about 0.005% to about 3%, or from about 0.1% to about 1%, by weight of the present liquid detergent compositions. Non-limiting examples of useful thickening stabilizers include: gums and other similar polysaccharides, for example gellan gum, carrageenan gum, and other known types of thickeners and rheological additives other than highly polyanionic types; thus conventional clays are not included. Exemplary stabilizers in this class include gum-type polymers (e.g. xanthan gum), polyvinyl alcohol and derivatives thereof, cellulose and derivatives thereof and tamarind gum (in some embodiments comprising xyloglucan polymers), guar gum, locust bean gum (in some embodiments comprising galactomannan polymers), and other industrial gums and polymers, which include, but are not limited to, Tara, Fenugreek, Aloe, Chia, Flaxseed, Psyllium seed, quince seed, xanthan, gellan, welan, rhamsan, dextran, curdlan, pullulan, scleroglucan, schizophyllan, chitin, hydroxyalkyl cellulose, arabinan (in some embodiments from sugar beets), de-branched arabinan (in some embodiments from sugar beets), arabinoxylan (in some embodiments from rye and wheat flour), galactan (in some embodiments from lupin and potatoes), pectic galactan (in some embodiments from potatoes), galactomannan (in some embodiments from carob, and including both low and high viscosities), glucomannan, lichenan (in some embodiments from icelandic moss), mannan (in some embodiments from ivory nuts), pachyman, rhamnogalacturonan, acacia gum, agar, alginates, carrageenan, chitosan, clavan, hyaluronic acid, heparin, inulin, cellodextrins, carboxymethylcellulose (CMC), dextrans, dextrins, ethylhydroxyethylcellulose (EHEC), guar, hydroxyethylcellulose (HEC), hydroxypropylcellulose (HPC), hydroxybutylcellulose (HBC), karaya, larch, methylcellulose (MC), tamarind, scleroglucan, xanthan, carboxymethylhydroxyethylcellulose (CMHEC), methoxypropyl methyl cellulose (MPMC), hexylcarboxymethyl cellulose, $C_{12}$-$C_{20}$ alkyl carboxymethylcellulose, methylhydroxyethylcellulose (MHEC), methylhydroxypropylcellulose (MHPC), hydroxyethylmethylcellulose (HEMC), hydroxypropylmethylcellulose (HPMC), hydroxybutylmethylcellulose (HBMC) and mixtures thereof.

(b) Nitrogen-Free Nonionic Surfactant

The present liquid detergent compositions may comprise detersive surfactants including, but not limited to nitrogen-free nonionic surfactants. Suitable levels of this component include from about 0.01% to about 80%, from about 0.1% to about 50%, or from about 1% to about 30% by weight of the liquid detergent compositions.

Suitable surfactants of this type can be prepared using any suitable means. For example they may be prepared from alkoxylates including, but not limited to, ethylene oxide, propylene oxide, butylene oxide and mixed alkylene oxide condensates of any suitable detergent alcohols having linear of branched hydrocarbyl moieties. Exemplary nonionic surfactants of this type include the following:

1) $C_9$-$C_{18}$ alkyl ethoxylates, such as, NEODOL® nonionic surfactants from Shell Chemicals (Houston, Tex.);
2) $C_6$-$C_{12}$ alkyl phenol alkoxylates wherein the alkoxylate units are a mixture of ethyleneoxy and propyleneoxy units;
3) $C_{12}$-$C_{18}$ alcohol and $C_6$-$C_{12}$ alkyl phenol condensates with ethylene oxide/propylene oxide block polymers such as Pluronic® from BASF, AG (Ludwigshafen, Germany);
4) $C_{14}$-$C_{22}$ mid-chain branched alcohols, BA, as discussed in U.S. Pat. No. 6,150,322;
5) $C_{14}$-$C_{22}$ mid-chain branched alkyl alkoxylates, $BAE_x$, wherein x 1-30, as discussed in U.S. Pat. Nos. 6,153,577, 6,020,303 and 6,093,856;
6) Alkylpolysaccharides as disclosed in U.S. Pat. No. 4,565,647; specifically alkylpolyglycosides as disclosed in U.S. Pat. Nos. 4,483,780 and 4,483,779;
7) ether capped poly(oxyalkylated) alcohol surfactants as discussed in U.S. Pat. No. 6,482,994, WO 01/42408, and WO 01/42408; and
8) fatty acid ($C_{12}$-$C_{18}$) sorbitan esters, Span®, and their ethoxylated ($EO_{5-100}$) derivatives, polysorbates; such as Span®20, Tween® 20, Tween® 60, Tween® 80, which are commercially available from Uniqema (Edison, N.J.).

Other examples of ethoxylated surfactant include carboxylated alcohol ethoxylates.

Other nonionic surfactants of use include, but are not limited to alkylpolysaccharides as disclosed in U.S. Pat. No. 4,565,647 having a hydrophobic group containing from about 6 to about 30 carbon atoms, or from about 10 to about 16 carbon atoms and a polysaccharide, e.g., a polyglycoside having a hydrophilic group containing from about 1.3 to about 10 polysaccharide units. Any reducing saccharide containing 5 or 6 carbon atoms can be used. Optionally the hydrophobic group is attached at the 2-, 3-, 4-, etc. positions thus giving a glucose or galactose as opposed to a glucoside or galactoside. The intersaccharide bonds can be, e.g., between the one position of the additional saccharide units and the 2-, 3-, 4-, and/or 6-positions on the preceding saccharide units. In some embodiments, alkylpolyglycosides have the formula $RO(C_nH_{2n}O)t$(glycosyl)x wherein R is selected from alkyl, alkyl-phenyl, hydroxyalkyl, hydroxyalkylphenyl, and mixtures thereof in which the alkyl groups contain from about 10 to about 18, or from about 12 to about 14, carbon atoms; n is 2 or 3; t is from 0 to about 10; and x is from about 1.3 to about 10, from about 1.3 to about 3, or from about 1.3 to about 2.7, and the glycosyl may be derived from glucose.

(c) Nitrogen-Containing Detersive Surfactant

The present liquid detergent compositions may comprise detersive surfactants including, but not limited to nitrogen-containing surfactants. Suitable levels of this component include from about 0.01% to about 20%, from about 0.1% to about 15%, or from about 1% to about 10% by weight of the liquid detergent composition. Non-limiting examples of nitrogen-containing detersive surfactants of use are selected from cationic nitrogen-containing detersive surfactants, amine oxide surfactants, amine and amide-functional detersive surfactants (including fatty amidoalkylamines) and mixtures thereof. Ethoxylated quaternary ammonium and ethoxylated alkyl amine surfactants may also be used herein. Other such surfactants for use herein include, but are not limited to: polyhydroxy fatty acid amides as disclosed in U.S. Pat. No. 5,332,528, WO 92/06162, WO 93/19146, WO 93/19038, and WO 94/09099. The nitrogen-containing detersive surfactant is typically water-soluble and does not include silicone surfactants. Different surfactants of this type can be combined in varying proportions.

i) Cationic nitrogen containing detersive surfactants—Cationic nitrogen-containing detersive surfactants suitable for use in the compositions of the present invention are typically water-soluble and have at least one quatemized nitrogen and one long-chain hydrocarbyl group. Non-limiting examples of such cationic surfactants include the water-soluble alkyltrimethylammonium salts or their hydroxyalkyl substituted analogs, such as compounds having the formula $R_1R_2R_3R_4N^+X^-$ wherein $R_1$ is $C_8$-$C_{16}$ alkyl, each of $R_2$, $R_3$ and $R_4$ is independently $C_1$-$C_4$ alkyl, $C_1$-$C_4$ hydroxy alkyl, benzyl, and —$(C_2H_4O)_xH$ where x has a value from 2 to 5, and X is an anion. Not more than one of $R_2$, $R_3$ or $R_4$ should be benzyl. In some embodiments, the alkyl chain length for $R_1$ is $C_{12}$-$C_{15}$. In some embodiments, the groups for $R_2$, $R_3$ and $R_4$ are methyl and hydroxyethyl and the anion X may be selected from halide, methosulfate, acetate and phosphate.

ii) Amine Oxide Surfactants—These surfactants may have the formula:

$$R(EO)_x(PO)_y(BO)_zN(O)(CH_2R')_2.qH_2O$$

wherein:

R is a relatively long-chain hydrocarbyl moiety which can be saturated or unsaturated, linear or branched, and can contain from about 8 to about 20, preferably from about 10 to about 16 carbon atoms, and in some embodiments is a C12-C16 primary alkyl. R' is a short-chain moiety, and may be selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

iii) Amine and Amide Functional Detersive Surfactants—Non-limiting examples of this group of surfactants include the amine surfactants, and in some embodiments, an amine surfactant having the formula:

$$RX(CH_2)_xNR^2R^3$$

wherein:

R is $C_{6-12}$ alkyl; X is a bridging group which is selected from NH, CONH, COO, or O or X can be absent; x is from 2 to 4; $R_2$ and $R_3$ are each independently selected from H, $C_{1-4}$ alkyl, or ($CH_2$—$CH_2$—$O(R_4)$) wherein $R_4$ is H or methyl. In some embodiments, surfactants of this type include those selected from decyl amine, dodecyl amine, $C_{8-12}$ bis(hydroxyethyl) amine, $C_{8-12}$ bis(hydroxypropyl)amine, $C_{8-12}$ amido propyl dimethyl amine, and combinations thereof.

This group of surfactants may also include fatty acid amide surfactants having the formula $RC(O)NR'_2$ wherein R is an alkyl group containing from about 10 to about 20 carbon atoms and each R' is a short-chain moiety, in some embodiments selected from the hydrogen and $C_{1-4}$ alkyl and hydroxyalkyl. The $C_{10-18}$ N-alkyl polyhydroxy fatty acid amides may also be of use. Typical examples include the $C_{12-18}$ N-methylglucamides as disclosed in WO 92/06154. Other sugar-derived nitrogen-containing nonionic surfactants include the N-alkoxy polyhydroxy fatty acid amides, such as $C_{10-18}$ N-(3-methoxypropyl)glucamide.

(d) Coupling agent—Coupling agents suitable for use in the liquid detergent compositions of the present invention include, but are not limited to, fatty amines other than those which have marked surfactant character or are conventional solvents (such as the lower alkanolamines). Non-limiting examples of these coupling agents include hexylamine, octylamine, nonylamine and their C1-C3 secondary and tertiary analogs. Levels of this component, when present, are suitably in the range of from about 0.1% to about 20%, or from about 0.5% to about 5% by weight of the composition.

One useful group of coupling agents is selected from molecules which consist of two polar groups separated from each other by at least 5 or 6, aliphatic carbon atoms; compounds in this group are free from nitrogen and include, but are not limited to: 1,4 Cyclo Hexane Di Methanol (CHDM), 1,6 Hexanediol, 1,7 Heptanediol and combinations thereof; 1,4 Cyclo Hexane Di Methanol may be present in either its cis configuration, its trans configuration or a mixture of both configurations.

(e) Perfume—Perfumes may be incorporated into the fabric care compositions of the present invention. The perfume ingredients may be premixed to form a perfume accord prior to adding to the fabric care compositions of the present invention. As used herein, the term "perfume" encompasses individual perfume ingredients as well as perfume accords.

The level of perfume accord in the fabric care composition is typically from about 0.0001% to about 2% or higher, e.g., to about 10%; from about 0.0002% to about 0.8%; from about 0.003% to about 0.6%; or from about 0.005% to about 0.5% by weight of the liquid detergent composition.

The level of perfume ingredients in the perfume accord is typically from about 0.0001%, and in some embodiments from about 0.01%, to about 99%, from about 0.01% to about 50%, from about 0.2% to about 30%, from about 1% to about 20%, or from about 2% to about 10% by weight of the perfume accord.

The fabric care compositions of the present invention can comprise perfumes or perfume accords to provide a "scent signal" in the form of a pleasant odor which provides a freshness impression to the washed fabrics. The perfume ingredients are suitably at levels in the range from about 0.0001% to about 10% by weight of the liquid detergent composition and are characterized by their boiling points (B.P.). The perfume ingredients have a B.P, measured at the normal, standard pressure of 760 mm Hg, of about 240° C. or higher, and in some embodiments of about 250° C. or higher.

In some embodiments of the present invention, the perfume ingredients have a ClogP of greater than 3, or from about 3 to about 6. For purposes of the present invention ClogP values are calculated ClogP values. Such values may be obtained from the SciFinder database by American Chemical Society through Chemical Abstract Services (CAS), P.O. Box 3102, Columbus, Ohio 43210. If a ClogP value is not available from SciFinder, the value is calculated in accordance with the fragment approach in Hansch and Leo (cf., A. Leo, in comprehensive medicinal chemistry, Vol.4, C. Hansch, P. G. Sammens, J. B. Taylor and C. A. Ransden, Eds., P. 295, Pergamon Press, 1990, In some embodiments, the perfume accords used in the fabric care composition of the present invention contain at least 2 different perfume ingredients. In other embodiments, the perfume accords used in the fabric care composition of the present invention contain from at least 3 to at least 7 different perfume ingredients. Most common perfume ingredients which are derived from natural sources are comprised of a multitude of components. When each such material is used in formulating the perfume accords of the present invention, it is counted as one single ingredient, for the purpose of defining the invention.

Any type of perfume can be incorporated into the composition of the present invention including, but not limited to, perfume ingredients that are suitable for use to apply on fabrics and garments. Typical examples of such ingredients are disclosed in U.S. Pat. No. 5,445,747.

When long lasting fragrance odor on fabrics is desired, it may be of use to include at least an effective amount of perfume ingredients which have a boiling point of about 300° C. or higher. Non-limiting examples of such ingredients are disclosed in U.S. Pat. No. 5,500,138. In some embodiments, it may be of use to include materials that can slowly release perfume ingredients after the fabric is treated by the wrinkle control composition of this invention. Examples of materials of this type are disclosed in U.S. Pat. No. 5,531,910.

When cyclodextrin is present in the liquid detergent compositions, the perfume may be added at a level wherein even if all of the perfume in the composition were to complex with the cyclodextrin molecules, there will still be an effective level of uncomplexed cyclodextrin molecules present in the solution to provide adequate odor control. In order to reserve an effective amount of cyclodextrin molecules for odor control when cyclodextrin is present, perfume is typically present at a level wherein less than about 90%, less than about 50%, less than about 30%, or less than about 10% of the cyclodextrin complexes with the perfume. The cyclodextrin to perfume weight ratio may be greater than about 5:1, greater than about 8:1, greater than about 10:1, greater than about 20:1, greater than 40:1, or greater than about 70:1.

In some embodiments, the perfume is hydrophilic and is comprised predominantly of ingredients selected from two groups of ingredients: (a) hydrophilic ingredients having a ClogP of less than about 3.5, or less than about 3.0; and (b) ingredients having significant low detection threshold; and (c) mixtures thereof. Typically, at least about 50%, at least about 60%, at least about 70%, or at least about 80% by weight of the perfume is comprised of perfume ingredients of the above groups (a) and (b). For these perfumes, the cyclodextrin to perfume weight ratio is typically from about 2:1 to about 200:1; from about 4:1 to about 100:1, from about 6:1 to about 50:1, or from about 8:1 to about 30:1. Exemplary perfume ingredients of the above groups (a) and (b) are disclosed in U.S. Pat. No. 6,491,840.

Additionally, fabric substantive perfumes such as those disclosed in U.S. Pat. No. 6,903,061 are also useful herein. Non-limiting examples of such fabric substantive perfumes are selected from:

2-CYCLOPENTEN-1-ONE, 3-METHYL-2-(2-PENTENYL)-, (Z)-BUTANOIC ACID, 3-METHYL-, 4-METHYLPHENYL ESTER 2(5H)-FURANONE, 3,4-DIMETHYL-5-PENTYLIDENE-BUTANOIC ACID, 3-METHYL-, PHENYLMETHYL ESTER 2-BUTENOIC ACID, 2-METHYL-, PHENYLMETHYL ESTER, (E)-BENZENEBUTANOIC ACID, ETHYL ESTER BENZENEACETIC ACID, BUTYL ESTER BICYCLO[3.1.1] HEPT-2-ENE-2-METHANOL, 6,6-DIMETHYL-, ACETATE, (IS)-3-CYCLOHEXENE-1-PROPANAL, .BETA.,4-DIM ETHYL-CYCLOHEXANONE, 2-(1-CYCLOHEXEN-1-YL)-PROPANOIC ACID, 2-METHYL-, 1-METHYL-1-PHENYLETHYL ESTER 2,4-DECADIENAL 2,4-DECADIENAL, (E,E)-BUTANOIC ACID, 2-PHENYLETHYL ESTER CYCLOPROPANECARBOXYLIC ACID, 2-PENTYL-, TRANS-2-CYCLOPENTEN-1-ONE, 3-METHYL-2-(2-PENTENYL)-, (E)-2H-PYRAN-2-ONE, 6-HEXYLTETRAHYDRONONANOIC ACID, 2-ACETYL-, ETHYL ESTER BENZENEACETALDEHYDE, AR-(1-METHYLETHYL)-3-HEXANONE, 5-METHYL-5-PHENYL-OXACYCLODODECAN-2-ONE BUTANOIC ACID, 2-METHYL-,

2-PHENYLETHYL ESTER 5,8-METHANO-2H-1-BENZOPYRAN, 6-ETHYLIDENEOCTAHYDRO-ETHANONE, 1-[4-(1,1-DIMETHYLETHYL)PHENYL]-BENZENEPROPANOL, PROPANOATE 1,3-DIOXOLANE, 2-(2,6-DIMETHYL-1,5-HEPTADIENYL)-[1,1'-BICYCLOHEXYL]-2-ONE 1,3-BENZODIOXOLE, 5-PROPYL-PROPANOIC ACID, 2-METHYL-, 3-PHENYLPROPYL ESTER ETHANONE, 1-(4,7,7-TRIMETHYLBICYCLO[4.1.0]HEPT-4-EN-3-YL)-2H-PYRAN-2-ONE, 6-(3-HEXENYL)TETRAHYDRO-, (Z)-DISULFIDE, METHYL PHENYLMETHYL ETHANONE, 1-[4-(1-METHYLETHYL)PHENYL]-BENZENEPROPANOL, .BETA., .BETA.,3-TRIMETHYL-6-OCTENOIC ACID, 3,7-DIMETHYL-, (.+-.)-6-OCTENOIC ACID, 3,7-DIMETHYL-BENZENEPROPANAL, 4-ETHYL-.ALPHA.,.ALPHA.-DIMETHYL-2(3H)-FURANONE, 5-HEPTYLDIHYDRO-NONANOIC ACID PHENOL, 2-METHYL-5-(1-METHYLETHYL)-, ACETATE BENZENEMETHANOL, 4-(1-METHYLETHYL)-, ACETATE BENZENEACETALDEHYDE, 4-(1-METHYLETHYL)-PROPANOIC ACID, 2-METHYL-, 3-PHENYL-2-PROPENYL ESTER PHENOL, 5-METHYL-2-(1-METHYLETHYL)-, ACETATE BUTANOIC ACID, 2-PHENYLPROPYL ESTER ETHANONE, 1-[2-METHYL-5-(1-METHYLETHYL)PHENYL]-ACETALDEHYDE, [(3,7-DIMETHYL-6-OCTENYL)OXY]-2-FURANPROPANOIC ACID, 2-METHYLPROPYL ESTER BENZENE, (2-BUTOXYETHYL)-BUTANOIC ACID, 1-METHYL-2-PHENYLETHYL ESTER 2H-PYRAN, TETRAHYDRO4-METHYL-2-PHENYL-BENZENE, (2-ISOTHIOCYANATOETHYL)-DECANEDIOIC ACID, DIMETHYL ESTER BUTANOIC ACID, 3-METHYL-, 2-PHENYLETHYL ESTER 1,3-BENZODIOXOLE, 5-(1-PROPENYL)-HEXANOIC ACID, 2-FURANYLMETHYL ESTER BICYCLO[3.1.1]HEPT-2-ENE-2-PROPANAL, 6,6-DIMETHYL-PHENOL, (1,1-DIM ETHYLETHYL) 4-M ETHOXY-2H-PYRAN, 3,6-DIHYDRO-4-METHYL-2-PHENYL-PHENOL, 2-(1,1-DIMETHYLETHYL)4-METHOXY-2,6-OCTADIENOIC ACID, 3,7-DIMETHYL-2-PROPENOIC ACID, 2-METHYL-, 2-PHENYLETHYL ESTER FURAN, TETRAHYDRO-2,4-DIMETHYL4-PHENYL-BUTANOIC ACID, 2-PHENOXYETHYL ESTER 4,7-METHANO-1H-INDEN-5-OL, OCTAHYDRO-, ACETATE UNDECANOIC ACID, HYDROXY-, LACTONE OXIRANECARBOXYLIC ACID, 2-METHYL-3-(4-METHYLPHENYL)-, ETHYL ESTER BENZENE, 1,2-BIS(2-PROPENYLOXY)-2-FURANPROPANOIC ACID, 3-METHYLBUTYL ESTER BENZOIC ACID, 2-HYDROXY-, PROPYL ESTER NAPHTHALENE, 2-METHOXY-BENZENEPROPANOL, .GAMMA.-METHYLENE-, ACETATE 1,3-OCTANEDIOL, 2-METHYL-, DIACETATE 2-NONENOIC ACID 1,3-DIOXANE, 2,5,5-TRIMETHYL-2-PHENYL-4,7-METHANO-1H-INDEN-6-OL, 3A,4,5,6,7,7A-HEXAHYDRO-, PROPANOATE 2-PROPENOIC ACID, 3-PHENYL-, 1-METHYLETHYL ESTER 2-BUTENOIC ACID, 2-METHYL-, 2-PHENYLETHYL ESTER, (E)-2-BUTENOIC ACID, 2,3-DIMETHYL-, PHENYLMETHYL ESTER OCTANEDIOIC ACID, DIETHYL ESTER BENZENEPROPANAL, .ALPHA.-METHYL-4-(1-METHYLETHYL)-4,7-METHANO-1H-INDEN-5-OL, 3A,4,5,6,7,7A-HEXAHYDRO-, PROPANOATE BENZENE, [2-(1-PROPOXYETHOXY)ETHYL]-2-PROPENOIC ACID, 3-PHENYL, PROPYL ESTER BENZENEACETALDEHYDE, .ALPHA.-(2-M ETHYLPROPYLIDENE)-BUTANEDIOIC ACID, DIBUTYL ESTER BUTANOIC ACID, 3-PHENYL-2-PROPENYL ESTER SPIRO[1,4-METHANONAPHTHALENE-2(1H),2'-OXIRANE], 3,4,4A,5,8,8A-HEXAHYDRO-3',7-DIMETHYL-BENZENE, 1-ETHOXY-2-METHOXY-4-(1-PROPENYL)-1,3-BENZODIOXOLE, 5-(2-PROPENYL)-SPIRO[1,4-METHANONAPHTHALENE-2(1H),2'-OXIRANE], 3,4,4A,5,8,8A- HEXAHYDRO-3',6-DIMETHYL-1,3-DIOXANE, 4,4,6-TRIMETHYL-2-PHENYL-PHENOL, 3-(1,1-DIMETHYLETHYL)-4-METHOXY-PHENOL, 2-ETHOXY-5-(1-PROPENYL)-BENZENEBUTANOL, .BETA.,.DELTA.-DIMETHYL-2-PROPENOIC ACID, 3-PHENYL-, 2-PROPENYL ESTER BENZOIC ACID, 2-HYDROXY-5-M ETHYL-, ETHYL ESTER 1,3-NONANEDIOL, DIACETATE [1,1'-BICYCLOHEXYL]-4-ONE BENZENEPENTANOL, .BETA.-METHYL-1,3-DIOXANE, 2,4,6-TRIMETHYL-4-PHENYL-2H-PYRAN, TETRAHYDRO-2-METHYL4-METHYLENE-6-PHENYL-QUINOLINE, 6-(I-METHYLETHYL)-2H-PYRAN, 3,6-DIHYDRO-4,6-DIMETHYL-2-PHENYL-2H-PYRAN, 3,6-DIHYDRO-2,4-DIMETHYL-6-PHENYL-BUTANOIC ACID, 3-PHENYL-2-PROPENYL ESTER, (E)-BENZENEPROPANAL, 4-(1-METHYLETHYL)-BENZENEPENTANAL, BETA.-METHYL-1-OXASPIRO[4.5]DECAN-6-OL, 2,6,10,10-TETRAMETHYL-, CYCLOHEXANONE, 4-(1-ETHOXYETHENYL)-3,3,5,5-TETRAMETHYL-9-DECENOIC ACID BENZENEPENTANOL, .GAMMA.-METHYL-NONANEDIOIC ACID, DIETHYL ESTER BENZENEPROPANAL, 4-(1,1-DIMETHYLETHYL)-2-OCTANOL, 8,8-DIETHOXY-2,6-DIMETHYL-2-PENTENENITRILE, 3-METHYL-5-PHENYL-, (Z)-BUTANOIC ACID, 3-OXO-, 3,7-DIMETHYL-2,6-OCTADIENYL ESTER, (E)-BENZENEPROPANAL, .BETA.-METHYL-3-(1-METHYLETHYL)-BENZOIC ACID, 4-HYDROXY-, PROPYL ESTER UNDECANEDIOIC ACID, DIMETHYL ESTER 1H-INDEN-1-ONE, 2,3-DIHYDRO-2-(1-METHYLETHYL)-1,3-DIOXANE, 4,4,6-TRIMETHYL-2-(PHENYLMETHYL)-ETHANONE, 1-(5,6,7,8-TETRAHYDRO-2-NAPHTHALENYL)-BENZENEHEXANOL NONANEDIOL, DIACETATE 2-PROPENOIC ACID, 3-(4-METHOXYPHENYL)-, PROPYL ESTER 1,1'-BIPHENYL, 2-METHOXY-BENZOIC ACID, PHENYL ESTER BENZENE, 1,1'-[OXYBIS(METHYLENE)]BIS-BENZOIC ACID, 4-HYDROXY-, BUTYL ESTER 4,7-METHANO-1H-INDENE-2-METHANOL, OCTAHYDRO-, ACETATE 4,7-METHANO-1H-INDENEMETHANOL, OCTAHYDRO-, ACETATE [1,1'-BIPHENYL]-2-OL BENZOIC ACID, 2-HYDROXY-4-METHOXY-6-METHYL-, ETHYL ESTER 1,3-BENZODIOXOLE, 4,7-DIMETHOXY-5-(2-PROPENYL)-METHANONE, DIPHENYL-1(3H)-ISOBENZOFURANONE, 3-BUTYLIDENE-2-FURANCARBOXYLIC ACID, 2-PHENYLETHYL ESTER BENZOIC ACID, PHENYLMETHYL ESTER CYCLOPENTANECARBOXYLIC ACID, 2-HEXYL-3-OXO-, METHYL ESTER FURAN, 2,2'-[DITHIOBIS(METHYLENE)]BIS-BENZENEMETHANAMINE, N-(PHENYLMETHYL)-PYRIDINE, 2-(2-PHENYLETHYL)-2-PROPANONE, 1,3-DIPHENYL-2H-PYRAN, TETRAHYDRO-2-[2-METHOXY4-(2-PROPENYL)PHENOXY]-BENZENEACETIC ACID, 2-METHOXYPHENYL ESTER 2-CYCLOHEXENE-1-CARBOXYLIC ACID, 2-METHYL-4-OXO-6-PENTYL-, ETHYL ESTER 2-PROPEN-1-ONE, 1,3-DIPHENYL-METHANONE, (2-HYDROXY-4-METHOXYPHENYL)PHENYL-DODECANEDIOIC ACID TRIDECANEDIOIC ACID PIPERIDINE, 1-[5-(1,3-BENZODIOXOL-5-YL)-1-OXO-2,4-PENTADIENYL]-,(E,E)-

(f) Scavenger agent—The compositions of the present invention may comprise at least about 0.001%, from about 0.5% to about 10%, or about 5% by weight, of one or more scavenger agents. Scavenger agents suitable for use herein are selected from scavengers selected to capture fugitive dyes and/or anionic surfactants and/or soils.

Non-limiting examples of useful scavenger agents are selected from: fixing agents for anionic dyes; complexing agents for anionic surfactants; clay soil control agents; and combinations thereof. These materials can be combined at any suitable ratio. Suitable compounds are disclosed in commonly-owned patents to Gosselink et al and are commercially available from BASF, AG (Ludwigshafen, Germany), Ciba-Geigy (High Point, N.C.) and others.

(g) Dye Transfer Inhibiting Agents—The compositions of the present invention may comprise at least about 0.01%, from about 1% by weight, of one or more dye transfer inhibiting agents selected to capture fugitive dyes in the wash. Nonlimiting examples of dye transfer inhibiting agents are poly(vinylpyrrolidone) available from GAF Corp. (Wyane N.J.), polyvinyl pyrrolidone-co-vinyl imidazole commercially available from BASF, AG (Ludwigshafen, Germany) and poly(vinylpyridine-N oxide) available from Reilly Industries (Indianapolis, Ind.).

i) Fixing Agents for Anionic dyes—Dye fixing agents, "fixatives", or "fixing agents" are commercially available materials which are designed to improve the appearance of dyed fabrics by minimizing the loss of dye from fabrics due to washing. Not included within this definition are components which can in some embodiments serve as fabric softener actives.

Many fixing agents for anionic dyes are cationic, and are based on quatemized nitrogen compounds or on nitrogen compounds having a strong cationic charge which is formed in situ under the conditions of usage. Fixing agents are available under various trade names from several suppliers. Non-limiting examples of useful fixing agents include SANDOFIX TPS, SANDOFIX SWE (a cationic resinous compound), REWIN SRF, REWIN SRF-O, all of which are available form Clariant Corp. (Basel, Switzerland); REWIN DWR, from CHT-Beitlich GMBH (Frankfurt Germany); Tinofix® ECO, Tinofix® FRD and Solfin®, all of which are available from Ciba-Geigy (High Point, N.C.); and those disclosed in WO 99/14301. Other fixing agents for use in the compositions of the present invention are CARTAFIX CB®, from Clariant (Muttenz, SW) and the cyclic amine based polymers, oligomers or copolymers disclosed in WO 99/14300.

In some embodiments, useful fixing agents are described in "Aftertreatments for Improving the Fastness of Dyes on Textile Fibres", Christopher C. Cook, *Rev. Prog. Coloration*, Vol. XII, (1982). Dye fixing agents suitable for use in the present invention are ammonium compounds such as fatty acid-diamine condensates, inter alia the hydrochloride, acetate, methosulphate and benzyl hydrochloride salts of diamine esters. Non-limiting examples include oleyldiethyl aminoethylamide, oleylmethyl diethylenediamine methosulphate, and monostearylethylene diaminotrimethylammonium methosulphate. In addition, N-oxides other than surfactant-active N-oxides, more particularly polymeric N-oxides such as polyvinylpyridine N-oxide, are useful as fixing agents herein. Other useful fixing agents include derivatives of polymeric alkyldiamines, polyamine-cyanuric chloride condensates, and aminated glycerol dichlorohydrins. Other useful fixing agents include condensates of amine and epihalohydrin as described in U.S. Pat. Nos. 6,369,024, 6,733,538, 6,823,828 and 6,251,246.

Fixing agents for anionic dyes can be used in the present methods either in the form of such agents fully integrated into the inventive compositions, or by including them in a laundry treatment method according to the invention in the form of a separate article, for example a substrate article or sheet, which can be added to the wash along with the organosilicone containing composition. In this manner, the fixing agent can complement the use of the organosilicone composition. Combinations of such dye fixing articles and compositions comprising the organosilicones can be sold together in the form of a kit.

ii) Scavenger agents for anionic surfactants and/or soils—Suitable scavenger agents for anionic surfactants and/or soils include, but are not limited to, alkoxylated polyalkyleneimines and/or quatemized derivatives thereof.

(h) Fabric softeners—Fabric softeners, when present in the liquid detergent compositions of the present invention, are suitably at levels of up to about 30%, of from about 1% to about 20%, or from about 2% to about 10% by weight of the compositions. Suitable fabric softeners for use in the present invention include all the current commercial quaternary long-chain softeners, especially at least partially unsaturated esterquats with varying iodine value. Suitable fabric softeners more generally include fabric softening compounds which are cationic, water insoluble quaternary ammonium compounds comprising a polar head group and two long hydrocarbyl moieties; in some embodiments these are selected from alkyl, alkenyl and mixtures thereof, wherein each such hydrocarbyl moiety has an average chain length equal to or greater than $C_{12}$, greater than $C_{14}$, greater than $C_{16}$. In some embodiments, at least 50% of each long chain alkyl or alkenyl group is predominantly linear. In some embodiments, the overall chain length is about $C_{18}$, though mixtures of chain-lengths having non-zero proportions of lower, e.g., $C_{14}$, $C_{16}$ and some higher, e.g., $C_{20}$ chains can be desirable. The cationic softener can suitably be distearyl dimethyl ammonium chloride or unsaturated analogs thereof, but more preferably for the environment, the quaternary ammonium fabric softener is selected to be biodegradable. This property is present, for example, in the common commercial esterquat fabric softeners such as di(tallowyloxyethyl)dimethyl ammonium chloride.

In some embodiments, the fabric softening compound is a quaternary ammonium esterquat compound having two $C_{12-22}$ alkyl or alkenyl groups connected to a quaternary ammonium moiety via at least one ester moiety, or two such ester moieties. One esterquat ammonium fabric softener for use in the present compositions has the formula:

$\{(R^1)_2N((CH_2)_nER^2)_2\}^+X^-$ wherein each $R^1$ group is independently selected from $C_{1-4}$ alkyl, hydroxyalkyl or $C_{2-4}$ alkenyl; and wherein each $R^2$ is independently selected from $C_{8-28}$ alkyl or alkenyl groups; E is an ester moiety i.e., —OC(O)— or —C(O)O—, n is from 0-5, and $X^-$ is a suitable anion, for example chloride, methosulfate and mixtures thereof.

A second type of quaternary ammonium material can be represented by the formula: $\{(R^1)_3N(CH_2)_nCH(O(O)CR^2)CH_2O(O)CR^2\}^+X^-$ wherein each $R^1$ group is independently selected from $C_{1-4}$ alkyl, hydroxyalkyl or $C_{2-4}$ alkenyl; each $R^2$ is independently selected from $C_{8-28}$ alkyl or alkenyl groups; n is from 0-5; and $X^-$ is a suitable anion, for example chloride, methosulfate and mixtures thereof. This latter class can be exemplified by 1,2 bis[hardened tallowoyloxy]-3-trimethylammonium propane chloride.

Esterquat fabric softeners of use in the present invention that are commercially available in include, but are not limited to, materials comprising varying proportions of monoester in addition to diester.

Suitable fabric softeners herein include softening compounds having a solubility less than $1\times10^{-3}$ wt %, less than $1\times10^{-4}$ wt%, or from $1\times10^{-6}$ wt % to $1\times10^{-8}$ wt %, in demineralised water at 20C°.

(i) Detersive enzymes—Suitable detersive enzymes for use herein include, but are not limited to: protease; amylase; lipase; cellulase; carbohydrase including mannanase and endoglucanase; and mixtures thereof. Enzymes can be used at their art-taught levels, for example at levels recommended by suppliers such as Novozymes and Genencor. Typical levels in the compositions are from about 0.0001% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

(j) Bleach system—Bleach systems suitable for use herein contain one or more bleaching agents. Non-limiting examples of suitable bleaching agents are selected from: catalytic metal complexes; activated peroxygen sources; bleach activators; bleach boosters; photobleaches; bleaching enzymes; free radical initiators; $H_2O_2$; hypohalite bleaches; peroxygen sources, including but not limited to perborate and/or percarbonate and combinations thereof.

Examples of suitable catalytic metal complexes include, but are not limited to: manganese-based catalysts such as those disclosed in U.S. Pat. No. 5,576,282; cobalt based catalysts such as those disclosed in U.S. Pat. No. 5,597,936; and transition metal complexes of a macropolycyclic rigid ligand—abbreviated as "MRL", such as those disclosed in WO 00/332601, and U.S. Pat. No. 6,225,464. Non-limiting examples of suitable metals in the MRLs include Mn, Fe, Co, Ni, Cu, Cr, V, Mo, W, Pd, and Ru in their various oxidation states. Non-limiting examples of suitable MRLs include dichloro-5,12-diethyl-1,5,8,12-tetraazabicyclo[6.6.2]hexadecane manganese(II), dichloro-5,12-diethyl-1,5,8,12-tetraazabicyclo[6.6.2]hexadecane manganese(III) hexafluorophosphate and dichloro-5-n-butyl-12-methyl-1,5,8,12-tetraaza-bicyclo[6.6.2]hexadecane manganese(II).

Suitable activated peroxygen sources include, but are not limited to, preformed peracids, a hydrogen peroxide source in combination with a bleach activator, or a mixture thereof. Suitable preformed peracids include, but are not limited to, compounds selected from: percarboxylic acids and salts; percarbonic acids and salts; perimidic acids and salts; peroxymonosulfuric acids and salts; and combinations thereof. Suitable sources of hydrogen peroxide include, but are not limited to, compounds selected from: perborate compounds; percarbonate compounds; perphosphate compounds; and combinations thereof. Suitable types and levels of activated peroxygen sources are disclosed in U.S. Pat. Nos. 5,576,282, 6,306,812 and 6,326,348.

Suitable bleach activators include, but are not limited to, perhydrolyzable esters and perhydrolyzable imides such as, tetraacetyl ethylene diamine, octanoylcaprolactam, benzoyloxybenzenesulphonate, nonanoyloxybenzenesulphonate, benzoylvalerolactam, dodecanoyloxybenzenesulphonate.

Suitable bleach boosters include, but are not limited to, those described U.S. Pat. No. 5,817,614.

(k) Chelant—Suitable water-soluble chelants for use herein include citrates as well as nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems. Levels of chelant are typically lower than about 5%, more typically, chelants, when present, are at levels of from about 0.01% to about 3%.

(l) Carrier—Carriers of use in the present invention may include any suitable composition in which it is possible to produce organosilicone microemulsions having an average particle size of about 0.1 μm or less. In some embodiments, the carrier may be water alone or mixtures of organic solvents with water. In some embodiments, organic solvents include 1,2-propanediol, ethanol, glycerol and mixtures thereof. Other lower alcohols, $C_1$-$C_4$ alkanolamines such as monoethanolamine and triethanolamine, can also be used. Carriers can be absent, for example from anhydrous solid embodiments of the invention, but more typically are present at levels in the range of from about 0.1% to about 98%, from about 10% to about 95%, or from about 25% to about 75%.

(m) Mixtures of adjuncts—Mixtures of the above components can be made in any proportion.

(n) Other adjuncts—Examples of other suitable cleaning adjunct materials include, but are not limited to, fatty acids; alkoxylated benzoic acids or salts thereof such as trimethoxy benzoic acid or a salt thereof (TMBA); zwitterionic and/or amphoteric surfactants; enzyme stabilizing systems; inorganic builders including inorganic builders such as zeolites and water-soluble organic builders such as polyacrylates, acrylate/maleate copolymers and the like; coating or encapsulating agent including polyvinylalcohol film or other suitable variations, carboxymethylcellulose, cellulose derivatives, starch, modified starch, sugars, PEG, waxes, or combinations thereof; optical brighteners or fluorescers; soil release polymers; dispersants; suds suppressors; dyes; colorants; filler salts such as sodium sulfate; hydrotropes such as toluenesulfonates, cumenesulfonates and naphthalenesulfonates; photoactivators; hydrolyzable surfactants; preservatives; anti-oxidants; anti-shrinkage agents; anti-wrinkle agents; germicides; fungicides; color speckles; colored beads, spheres or extrudates; sunscreens; fluorinated compounds; clays; pearlescent agents; luminescent agents or chemiluminescent agents; anti-corrosion and/or appliance protectant agents; alkalinity sources or other pH adjusting agents; solubilizing agents; processing aids; pigments; free radical scavengers, and combinations thereof. Suitable materials include those disclosed in U.S. Pat. Nos. 5,705,464, 5,710,115, 5,698,504, 5,695,679, 5,686,014 and 5,646,101.

Incorporation of Organosilicones into Compositions of the Invention

Incorporation of organosilicones into liquid detergent compositions having any suitable form including, but not limited to: pourable liquids, gels, and creams can be accomplished in any suitable manner and can, in general, involve any order of mixing or addition. However, certain means of such incorporation have been discovered.

A first method involves introducing the organosilicones as received from the manufacturer directly into a preformed mixture of two or more of the other components of the final composition. This can be accomplished at any point in the process of preparing the final composition, including at the very end of the formulating process; that is, the organosilicones can be added to a pre-made liquid laundry detergent to form the final composition of the present invention.

A second method involves premixing the organosilicone polymer with an emulsifier and water to prepare the organosilicone microemulsion, which is then mixed with other components of the final composition. These components can be added in any order and at any point in the process of preparing the final composition.

A third method involves mixing the organosilicone polymer with one or more adjuncts of the final composition and adding this premix to a mixture of the remaining adjuncts.

Liquid detergent compositions in accordance with the present invention, may comprise a stabilizer, such as trihydroxystearin or hydrogenated castor oil, for example the type commercially available as Thixcin®. When a stabilizer is to be added to the present compositions, it may be introduced as a separate stabilizer premix with one or more of the adjuncts, or non-silicone components, of the composition. When such a stabilizer premix is used, it is may be added into the composition after the organosilicone polymer has already been introduced and dispersed in the composition.

EXAMPLES

The following non-limiting examples are illustrative of the present invention. Examples 1-27 are illustrate formulations for pourable liquids. Examples 28-38 are illustrative formulations of gels. Percentages are by weight of the liquid detergent composition unless otherwise specified.

Examples 1-21

| Ingredient | Wt % |
|---|---|
| C12-15alkyl polyethoxylate (1.8) sulfate[1] | 18.0 |
| Ethanol | 2.5 |
| Diethylene glycol | 1.3 |
| Propandiol | 3.5 |
| C12-13Alkyl polyethoxylate (9)[1] | 0.4 |
| C12-14 fatty acid | 2.5 |
| Sodium cumene sulfonate | 3.0 |
| Citric acid | 2.0 |
| Sodium hydroxide (to pH 8.0) | 1.5 |
| Protease (32 g/L)[2] | 0.3 |
| Self Emulsifying Silicone from Table 1 | 2.0 |
| Soil suspending polymers | 1.1 |
| Water, perfume, enzymes, suds suppressor, brightener, enzyme stabilizers & other optional ingredients | to 100% |

[1]Supplied by Shell Chemicals, Houston, TX
[2]Supplied by Genencor International, South San Francisco, CA

| Example | Self-emulsifying Silicone | Supplied by |
|---|---|---|
| 1 | Dow Corning BY 16-878 ® | Dow Corning Corporation, Midland MI |
| 2 | Ultrasil ® A-21 | Noveon Inc., Cleveland, OH |
| 3 | Utltasil ® A-23 | Noveon Inc., Cleveland, OH |
| 4 | X22-3939 A ® | Shin-Etsu Corporation, Tokyo, Japan |
| 5 | Magnasoft TLC ® | GE Silicones, Greenwich CT |
| 6 | Ultrasil ® SA-1 | Noveon Inc. Cleveland, OH |
| 7 | Ultrasil ® CA-1 | Noveon Inc. Cleveland, OH |
| 8 | Ultrasil ® CA-2 | Noveon Inc. Cleveland, OH |
| 9 | Silsoft ® A-858 | GE Silicones, Greenwich CT |

-continued

| Example | Self-emulsifying Silicone | Supplied by |
|---|---|---|
| 10 | Pecosil ® PS 150 | Phoenix Chemicals, Somerville, NJ |
| 11 | Pecosil ® PAN 150 | Phoenix Chemicals, Somerville, NJ |
| 12 | Dow Corning FF-400 | Dow Corning Corporation, Midland MI |
| 13 | PP-5495 | Dow Corning Corporation, Midland MI |
| 14 | KF-888 | Shin-Etsu Corporation, Tokyo, Japan |
| 15 | KF-889 | Shin-Etsu Corporation, Tokyo, Japan |
| 16 | Wacker FC-203 | Wacker Silicones, Adrian MI |
| 17 | Wacker SLM 21-200 | Wacker Silicones, Adrian MI |
| 18 | Wetsoft NE 810VP | Wacker Silicones, Adrian MI |
| 19 | SH 3775C | Dow Corning Corporation, Midland MI |
| 20 | Silsoft A-553 | GE Silicones, Greenwich CT |
| 21 | DC 19-906 | Dow Corning Toray Silicones, |

Example 22-23

| Ingredient | Wt % | WT % |
|---|---|---|
| C12-15alkyl polyethoxylate (1.8) sulfate | 20.1 | 15.0 |
| Methyl Ester sulfonate[4] | — | 5.0 |
| Ethanol | 2.8 | 2.8 |
| C12-13Alkyl polyethoxylate (9)[1] | 0.29 | 0.29 |
| C12-14 fatty acid | 2.09 | 2.09 |
| C12 Trimethylammonium chloride[2] | 2.1 | 2.1 |
| Sodium cumene sulfonate | 1.80 | 1.80 |
| Citric acid | 3.36 | 3.36 |
| Sodium hydroxide (to pH 8.0) | 2.70 | 2.70 |
| Protease (32 g/L)[3] | 0.42 | 0.42 |
| Silicone from Table 1 | 4.0 | 4.0 |
| Soil suspending polymers | 1.3 | 1.3 |
| Water, perfume, enzymes, suds suppressor, brightener, enzyme stabilizers & other optional ingredients | To 100% | To 100% |

[1]Supplied by Shell Chemicals (Houston, TX)
[2]Supplied by Akzo Chemicals (Chicago, IL)
[3]Supplied by Genencor International (South San Francisco, CA)
[4]Supplied by Stepan Chemicals of Northfield, IL

| Ingredient (assuming 100% activity) | 24 weight % | 25 weight % | 26 weight % | 27 weight % |
|---|---|---|---|---|
| AES[1] | 10.6 | 10.6 | 10.6 | 10.6 |
| Linear alkyl benzene sulfonate[2] | 0.8 | 0.8 | 0.8 | 0.8 |
| Neodol 45-8[3] | 6.3 | 6.3 | 6.3 | 6.3 |
| Citric Acid | 3.8 | 3.8 | 3.8 | 3.8 |
| $C_{12-18}$ Fatty Acids | 7.0 | 7.0 | 7.0 | 7.0 |
| Protease B[4] | 0.35 | 0.35 | 0.35 | 0.35 |
| Tinopal AMS-X[5] | 0.09 | 0.09 | 0.09 | 0.09 |
| Zwitterionic ethoxylated quaternized sulfated hexamethylene diamine[6] | 1.11 | 1.11 | 1.11 | 1.11 |
| Dequest 2010[7] | 0.17 | 0.17 | 0.17 | 0.17 |
| Silicone from Table 1 | 4.0 | 4.0 | 4.0 | 4.0 |
| Cationic HEC[8] | 0.28 | — | — | — |
| Acrylamide/MAPTAC[9] | — | 0.47 | — | — |
| Mirapol 550[10] | — | — | 0.47 | — |
| Hydrogenated castor oil | 0.2 | 0.2 | 0.2 | 0.2 |
| Mica/TiO2[11] | 0.2 | 0.2 | 0.2 | 0.2 |
| Ethyleneglycol distearate[12] | 0.2 | 0.2 | 0.2 | 0.2 |
| water, perfumes, dyes, and | to | to | to | to |

-continued

| Ingredient (assuming 100% activity) | 24 weight % | 25 weight % | 26 weight % | 27 weight % |
|---|---|---|---|---|
| other optional agents/components | 100% balance | 100% balance | 100% balance | 100% balance |

[1]$C_{10}$-$C_{18}$ alkyl ethoxy sulfate, supplied by Shell Chemicals, Houston, TX
[2]supplied by Huntsman Chemicals, Salt Lake City, UT
[3]supplied by Shell Chemicals, Houston, TX
[4]Supplied by Genencor International, South San Francisco, CA
[5]Supplied by Ciba Specialty Chemicals (High Point, NC)
[6]available under the tradename LUTENSIT ® from BASF (Ludwigshafen, Germany) and such as those described in WO 01/05874

-continued

| Ingredient (assuming 100% activity) | 24 weight % | 25 weight % | 26 weight % | 27 weight % |
|---|---|---|---|---|

[7]supplied by Aldrich Chemicals Milwaukee WI
[8]supplied by Dow Chemicals, Edgewater, NJ
[9]supplied by Nalco Chemicals of Naperville, IL
[10]Supplied by Rhodia Chemie, Aubervilliers, France
[11]supplied by Ekhard America, Louisville, KY
[12]Supplied by Degussa Corporation, Hopewell, VA

Examples 28-38

| | Example Number: | | | | | | | |
|---|---|---|---|---|---|---|---|---|
| Ingredients (assuming 100% activity) | 28 weight % | 29 weight % | 30 weight % | 31 weight % | 32 weight % | 33 weight % | 34 weight % | 31 weight % |
| C12-15 Alkyl polyethoxylate (1.8) sulphate, Na salt | — | 20 | — | 20 | — | 20 | — | 20 |
| C12-15 Alkyl polyethoxylate (3.0) sulphate, Na salt | 12 | — | 12 | — | 12 | — | 12 | — |
| C12-14 alkylpolyethoxylate (7) | 1.9 | 0.3 | 1.9 | 0.3 | 1.9 | 0.3 | 1.9 | 0.3 |
| C12 linear alkylbenzene sulfonic acid | 2.9 | — | 2.9 | — | 2.9 | — | 2.9 | — |
| C12 alkyl, N,N.N trimethyl ammonium chloride | — | 2.2 | — | 2.2 | — | 2.2 | — | 2.2 |
| C12-18 fatty acids | 7.4 | 5.0 | 7.4 | 5.0 | 7.4 | 5.0 | 7.4 | 5.0 |
| Citric acid | 1.0 | 3.4 | 1.0 | 3.4 | 1.0 | 3.4 | 1.0 | 3.4 |
| Hydroxyethylidene 1,1 diphosphonic acid | 0.25 | — | 0.25 | — | 0.25 | — | 0.25 | — |
| Diethylenetriamine pentaacetic acid | — | 0.50 | — | 0.50 | — | 0.50 | — | 0.50 |
| Trans-Sulfated Ethoxylated Hexamethylene Diamine Quat | 1.9 | — | 1.9 | — | 1.9 | — | 1.9 | — |
| Acrylamide/ MAPTAC | 0.4 | 0.4 | — | — | 0.4 | 0.4 | — | — |
| Lupasol SK[1] | — | — | 3.0 | 3.0 | — | — | 3.0 | 3.0 |
| Carezyme | 0.1 | — | 0.1 | — | 0.1 | — | 0.1 | — |
| 1,2 propandiol | 1.7 | 3.8 | 1.7 | 3.8 | 1.7 | 3.8 | 1.7 | 3.8 |
| Ethanol | 1.5 | 2.8 | 1.5 | 2.8 | 1.5 | 2.8 | 1.5 | 2.8 |
| Diethyleneglycol | — | 1.5 | — | 1.5 | — | 1.5 | — | 1.5 |
| Boric acid | 1.0 | 1.0 | 1.0 | 1.0 | 1.0 | 1.0 | 1.0 | 1.0 |
| Na Cumene sulfonate | — | 1.7 | — | 1.7 | — | 1.7 | — | 1.7 |
| Monoethanolamine | 3.3 | 2.5 | 3.3 | 2.5 | 3.3 | 2.5 | 3.3 | 2.5 |
| Perfume | 0.9 | 0.6 | 0.9 | 0.6 | 0.9 | 0.6 | 0.9 | 0.6 |
| Hydrogenated castor oil | 0.1 | — | 0.1 | — | 0.1 | — | 0.1 | — |
| Pearlescent agent (mica) | 0.1 | 0.05 | 0.1 | 0.05 | 0.1 | 0.05 | 0.1 | 0.05 |
| PP 5495[2] | 6.0 | 6.0 | 6.0 | 6.0 | — | — | — | — |
| SLM 21200[3] | — | — | — | — | 6.0 | 6.0 | 6.0 | 6.0 |
| NaOH | To pH 8.0 | To pH 8.0 | To pH 8.0 | To pH 8.0 | To pH 8.0 | To pH 8.0 | To pH 8.0 | To pH 8.0 |
| water | balance | balance | balance | balance | balance | balance | balance | balance |

[1]Polyethyleneimine polymer amidated with acetic acid available from BASF (Ludwigshafen, GE).
[2]Silicone polyether commercially available from Dow Corning (Midland MI).
[3]Copolymer of silicone polyether and hexamethylene diisocyanate available from Wacker (Munich, Germany)

| Ingredients (assuming 100% activity) | Example Number: 35 weight % | 36 weight % | 37 weight % | 38 weight % |
|---|---|---|---|---|
| C12-15 Alkyl polyethoxylate (1.8) sulphate, Na salt | 20 | 20 | 20 | 20 |
| C12-15Alkyl polyethoxylate (3.0) sulphate, Na salt | — | — | — | — |
| C12-14 alkylpolyethoxylate (7) | 0.3 | 0.3 | 0.3 | 0.3 |
| C12 linear alkylbenzene sulfonic acid | — | — | — | — |
| C12 alkyl, N,N.N trimethyl ammonium chloride | 2.2 | 2.2 | 2.2 | 2.2 |
| C12-18 fatty acids | 5.0 | 5.0 | 5.0 | 5.0 |
| Citric acid | 3.4 | 3.4 | 3.4 | 3.4 |
| Hydroxyethylidene 1,1 diphosphonic acid | — | — | — | — |
| Diethylenetriamine pentaacetic acid | 0.50 | 0.50 | 0.50 | 0.50 |
| Trans-Sulfated Ethoxylated Hexamethylene Diamine Quat | — | — | — | — |
| Acrylamide/MAPTAC | 0.4 | 0.4 | 0.4 | — |
| Lupasol SK (1) | — | — | — | 3.0 |
| Carezyme | — | — | — | — |
| 1,2 propandiol | 3.8 | 3.8 | 3.8 | 3.8 |
| Ethanol | 2.8 | 2.8 | 2.8 | 2.8 |
| Diethyleneglycol | 1.5 | 1.5 | 1.5 | 1.5 |
| Boric acid | 1.0 | 1.0 | 1.0 | 1.0 |
| Na Cumene sulfonate | 1.7 | 1.7 | 1.7 | 1.7 |
| Monoethanolamine | 2.5 | 2.5 | 2.5 | 2.5 |
| Perfume | 0.6 | 0.6 | 0.6 | 0.6 |
| Hydrogenated castor oil | 0.2 | 0.2 | 0.2 | 0.1 |
| Pearlescent agent (mica) | 0.05 | 0.05 | 0.05 | 0.05 |
| PP 5495 (2) | — | 6.0 | — | — |
| SLM 21200 (3) | — | — | 6.0 | 6.0 |
| NaOH | To pH 8.0 | To pH 8.0 | To pH 8.0 | To pH 8.0 |
| water | balance | balance | balance | balance |

Product with Instructions for use

The liquid detergent compositions of the present invention are typically included in a product. In some embodiments, the product comprises a fabric care composition in accordance with the present invention, and further comprises instructions for using the product to launder fabrics by contacting a fabric in need of treatment with an effective amount of the composition such that the composition imparts one or more desired fabric care benefits to the fabric.

The present invention therefore also encompasses the inclusion of instructions on the use of the fabric care compositions of the present invention with packages containing the compositions herein or with other forms of advertising associated with the sale or use of the compositions. The instructions may be included in any manner typically used by consumer product manufacturing or supply companies; non-limiting examples include providing instructions: on a label attached to the container holding the composition; on a sheet either attached to the container or accompanying it when purchased; in advertisements, demonstrations, and/or other written or oral instructions which may be connected to the purchase or use of the compositions; and combinations thereof.

The instructions may include a description of the use of the composition, for instance, the recommended amount of composition to use in a washing machine to clean the fabric; the recommended amount of composition to apply to the fabric; if soaking or rubbing is appropriate.

Service Business use

Any of the above systems, compositions and methods can be used in a laundry service business, for example in a dry-cleaning establishment, an institutional laundry (such as school, hotel or military field laundry) or similar, without departing from the spirit and scope of the invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition for fabric cleaning and fabric care comprising:

A. an organosilicone having formula (I):

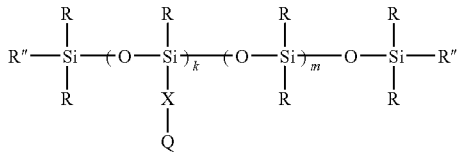

(I)

wherein:

(a) each R" is independently selected from R and —X-Q; wherein:

(i) R is a group selected from: a $C_1$-$C_8$ alkyl or aryl; hydrogen; a $C_1$-$C_3$ alkoxy; and combinations thereof;

(b) X is a linking group selected from: an alkylene; $—(CH_2)_p—$; or $—CH_2—CH(OH)—CH_2—$; wherein:

(i) p is on average from about 2 to about 6, (c) Q is $—(O—CHR_2—CH_2)_q—Z$; wherein q is on average from about 0 to about 20; and further wherein:

(i) $R_2$ is a group selected from: H; or a $C_1$-$C_3$ alkyl; and (ii) Z is a group selected from: $—OR_3$; $—OC(O)R_3$; $—CO—R_4—COOH$; $—SO_3$; $—PO(OH)_2$; and:

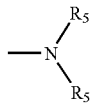

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;
2. $R_4$ is a group selected from: $—CH_2—$; or $—CH_2CH_2—$;
3. $R_5$ is a group independently selected from: H; $C_1$-$C_3$ alkyl; $—(CH_2)_p—NH_2$; and $—X(—O—CHR_2—CH_2)_s—Z$; wherein:

a. p is on average from about 2 to about 6; and b. s is on average from about 1 to about 10;

(d) k is on average from about 1 to about 25,000, or from about 3 to about 12,000; and (e) m is on average from about 4 to about 50,000, or from about 10 to about 20,000

B. an emulsifier comprising anionic surfactant;

C. a detersive enzyme;

D. a nitrogen-containing detersive surfactant selected from the group consisting of an amine oxide surfactant, an amine-functional detersive surfactant, an amide-functional detersive surfactant; and combinations thereof;

E. other laundry adjunct materials; and

F. a carrier comprising water;

wherein the organosilicone is in the form of a microemulsion having an average particle size of less than about 0.1 μm, and the composition has a viscosity of from about 1 to about 5,000 mPa*s at 25° C. and a shear rate of 20 $sec^{-1}$.

2. The composition according to claim 1 wherein the organosilicone has the formula (II):

(II)

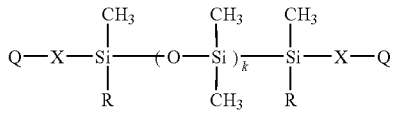

wherein:

(a) each R is a group independently selected from: a $C_1$-$C_8$ alkyl or aryl; hydrogen; a $C_1$-$C_3$ alkoxy; or combinations thereof;

(b) X is a linking group selected from an alkylene group; in some embodiments the alkylene group is selected from: —$(CH_2)_p$—; and —$CH_2$—CH(OH)—$CH_2$—; wherein:

(i) p is on average from about 2 to about 6;

(c) Q is —(O—$CHR_2$—$CH_2)_q$—Z; wherein q is on average from about 0 to about 20; and further wherein:

(i) $R_2$ is a group selected from: H; or a $C_1$-$C_3$ alkyl; and (ii) Z is a group selected from: —$OR_3$; —OC(O)$R_3$; —CO—$R_4$—COOH; —$SO_3$; —$PO(OH)_2$; and

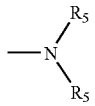

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;

2. $R_4$ is a group selected from: —$CH_2$—; and —$CH_2CH_2$—;

3. $R_5$ is a group independently selected from: H; $C_1$-$C_3$ alkyl; —$(CH_2)_p$—$NH_2$; and —X(—O—$CHR_2$—$CH_2)_s$-Z; wherein:

a. p is on average from about 2 to about 6; and b. s is on average from about 1 to about 10; and (d) k is on average from about 1 to about 25,000, or from about 3 to about 12,000; and (e) m is on average from about 4 to about 50,000, or from about 10 to about 20,000.

3. The composition according to claim 1 wherein the organosilicone has the formula (III):

(III)

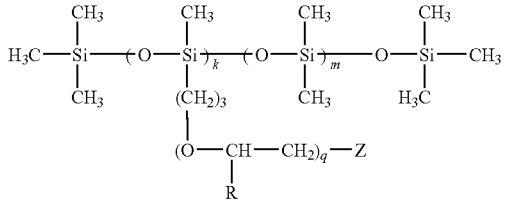

wherein:

(a) R is a group selected from: hydrogen or $C_1$-$C_3$ alkyl;

(b) Z is a group selected from: —$OR_3$; —OC(O)$R_3$; —CO—$R_4$—COOH; —$SO_3M$; —$PO(OH)_2$; and:

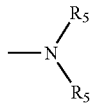

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;

2. $R_4$ is a group selected from: —$CH_2$—; and —$CH_2CH_2$—;

3. $R_5$ is a group independently selected from: H, $C_1$-$C_3$ alkyl; —$(CH_2)_p$—$NH_2$; and —X(—O—$CHR_2$—$CH_2)_s$—Z; wherein:

a. p is on average from about 2 to about 6; and b. s is on average from about 1 to about 10; and (c) k is on average from about 1 to about 25,000, or from about 3 to about 12,000.

4. The composition according to claim 1 wherein the anionic surfactant is selected from the group consisting of: $C_{11}$-$C_{18}$ alkyl benzene sulfonates (LAS); $C_{10}$-$C_{20}$ branched-chain and random alkyl sulfates (AS); $C_{10}$-$C_{18}$ alkyl ethoxy sulfates ($AE_xS$) wherein x is from 1-30; mid-chain branched alkyl sulfates; mid-chain branched alkyl alkoxy sulfates; $C_{10}$-$C_{18}$ alkyl alkoxy carboxylates comprising 1-5 ethoxy units; modified alkylbenzene sulfonate (MLAS); $C_{12}$-$C_{20}$ methyl ester sulfonate (MES); $C_{10}$-$C_{18}$ alpha-olefin sulfonate (AOS); $C_6$-$C_{20}$ sulfosuccinates; and combinations thereof.

5. The composition according to claim 1 further comprising nonionic surfactant selected from the group consisting of: $C_9$-$C_{18}$ alkyl ethoxylates; $C_6$-$C_{12}$ alkyl phenol alkoxylates; $C_{12}$-$C_{18}$ alcohol and $C_6$-$C_{12}$ alkyl phenol condensates with ethylene oxide/propylene oxide block polymers; $C_{14}$-$C_{22}$ mid-chain branched alcohols; $C_{14}$-$C_{22}$ mid-chain branched alkyl alkoxylates; alkylpolyglycosides; polyhydroxy fatty acid amides; ether capped poly(oxyalkylated) alcohols; fatty acid ($C_{12}$-$_{18}$) sorbitan esters; and combinations thereof.

6. The composition according to claim 1 wherein the laundry adjunct material is selected from the group consisting of: stabilizer; nitrogen-free nonionic surfactant; coupling agent; perfume; scavenger agent; fabric softener; bleach system; chelant; carrier; and combinations thereof.

7. The composition according to claim 1, further comprising perfume having a ClogP of greater than 3.

8. The composition according to claim 1, wherein the composition is in a form selected from the group consisting of: pourable liquid; gel; and cream.

9. The composition according to claim 1, wherein the organosilicone is reacted with an organic compound having two or more isocyanate groups per molecule to form a hydrophilic siloxane.

10. A liquid detergent composition comprising:

A. from about 0.01 to about 10% by weight of the composition of organosilicone having formula (I):

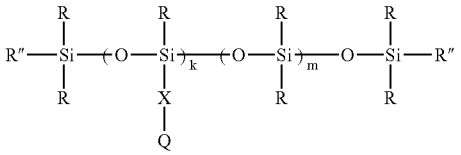

(I)

wherein:

(a) each R" is independently selected from R and —X-Q; wherein:

(i) R is a group selected from: a $C_1$-$C_8$ alkyl or aryl; hydrogen; a $C_1$-$C_3$ alkoxy; and combinations thereof (b) X is a linking group selected from: an alkylene; $—(CH_2)_p—$; or $—CH_2—CH(OH)—CH_2—$; wherein:

(i) p is on average from about 2 to about 6, (c) Q is $—(O—CHR_2—CH_2)_q—Z$; wherein q is on average from about 0 to about 20; and further wherein:

(i) $R_2$ is a group selected from: H; or a $C_1$-$C_3$ alkyl; and (ii) Z is a group selected from: $—OR_3$; $—OC(O)R_3$; —CO—R—COOH; $—SO_3$; $—PO(O)_2$; and:

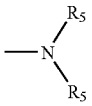

wherein:

1. $R_3$ is a group selected from: H; $C_1$-$C_{26}$ alkyl or substituted alkyl; $C_6$-$C_{26}$ aryl or substituted aryl; $C_7$-$C_{26}$ alkylaryl or substituted alkylaryl;

2. $R_4$ is a group selected from: $—CH_2—$; or $—CH_2CH_2—$;

3. $R_5$ is a group independently selected from: H; $C_1$-$C_3$ alkyl; $—(CH_2)_p—NH_2$; and $—X(—O—CHR_2—CH_2)_s—Z$; wherein:

a. p is on average from about 2 to about 6; and b. s is on average from about 1 to about 10;

(d) k is on average from about 1 to about 25,000, or from about 3 to about 12,000; and (e) m is on average from about 4 to about 50,000, or from about 10 to about 20,000

B. from about 0.05 to about 15% by weight of the composition of anionic surfactant;

C. a detersive enzyme;

D. a nitrogen-containing detersive surfactant selected from the group consisting of an amine oxide surfactant, an amine-functional detersive surfactant, an amide-functional detersive surfactant; and combinations thereof;

E. from about 0.0001 to about 20% by weight of the composition of one or more laundry adjunct materials; and F. the balance of water;

wherein the organosilicone is emulsified to an average particle size of from about 1 nm to about 500 nm, the composition has a viscosity of from about 1 to about 5,000 mPa*s at 25° C. and a shear rate of 20 $sec^{-1}$ and the composition is a transparent fabric care composition.

11. The composition according to claim 10 wherein the anionic surfactant is selected from the group consisting of: $C_{11}$-$C_{18}$ alkyl benzene sulfonates (LAS); $C_{10}$-$C_{20}$ branched-chain and random alkyl sulfates (AS); $C_{10}$-$C_{18}$ alkyl ethoxy sulfates ($AE_xS$) wherein x is from 1-30; mid-chain branched alkyl sulfates; mid-chain branched alkyl alkoxy sulfates; $C_{10}$-$C_{18}$ alkyl alkoxy carboxylates comprising 1-5 ethoxy units; modified alkylbenzene sulfonate (MLAS); $C_{12}$-$C_{20}$ methyl ester sulfonate (MES); $C_{10}$-$C_{18}$ alpha-olefin sulfonate (AOS); $C_6$-$C_{20}$ sulfosuccinates; and combinations thereof.

12. The composition according to claim 10 further comprising nonionic surfactant selected from the group consisting of: $C_9$-$C_{18}$ alkyl ethoxylates; $C_6$-$C_{12}$ alkyl phenol alkoxylates; $C_{12}$-$C_{18}$ alcohol and $C_6$-$C_{12}$ alkyl phenol condensates with ethylene oxide/propylene oxide block polymers; $C_{14}$-$C_{22}$ mid-chain branched alcohols; $C_{14}$-$C_{22}$ mid-chain branched alkyl alkoxylates; alkylpolyglycosides; polyhydroxy fatty acid amides; ether capped poly(oxyalkylated) alcohols; fatty acid ($C_{12}$-$_{18}$) sorbitan esters; and combinations thereof.

13. The composition according to claim 10 wherein the laundry adjunct material is selected from the group consisting of: stabilizer; nitrogen-free nonionic surfactant; coupling agent; perfume; scavenger agent; fabric softener; bleach system; chelant; carrier; and combinations thereof.

14. The composition according to claim 10, further comprising perfume having a ClogP of greater than 3.

15. A method for treating a substrate comprising contacting the substrate with a fabric care composition according to claim 1 such that the substrate is treated.

16. A method for treating a substrate comprising contacting the substrate with a fabric care composition according to claim 10 such that the substrate is treated.

17. A treated substrate made by contacting the substrate with the composition of claim 1.

18. A treated substrate made by contacting the substrate with the composition of claim 10.

19. A method for producing a fabric care composition according to claim 1 comprising the steps of:

A. forming a microemulsion premix by premixing the emulsifier, organosilicone, and water; and B. mixing the premix from A with the enzyme, nitrogen-containing detersive surfactant, and laundry adjunct materials.

* * * * *